US011656050B2

(12) United States Patent
Burnett

(10) Patent No.: US 11,656,050 B2
(45) Date of Patent: May 23, 2023

(54) FIREARM POSITIONING SYSTEMS AND METHODS

(71) Applicant: Tac-Clamp, LLC, Parker, CO (US)

(72) Inventor: David Burnett, Parker, CO (US)

(73) Assignee: TAC-CLAMP, LLC, Parker, CO (US)

( * ) Notice: Subject to any disclaimer, the term of this patent is extended or adjusted under 35 U.S.C. 154(b) by 0 days.

(21) Appl. No.: 17/506,020

(22) Filed: Oct. 20, 2021

(65) Prior Publication Data

US 2022/0120529 A1 Apr. 21, 2022

Related U.S. Application Data

(60) Provisional application No. 63/094,804, filed on Oct. 21, 2020.

(51) Int. Cl.
*F41A 23/06* (2006.01)
*F41A 23/00* (2006.01)

(52) U.S. Cl.
CPC ..... *F41A 23/06* (2013.01); *F41A 23/005* (2013.01)

(58) Field of Classification Search
CPC ..... F41A 23/005; F41A 23/02; F41A 23/04; F41A 23/06; F41A 23/20
USPC ..... 89/37.01, 37.03, 37.04, 37.11, 38, 40.01, 89/40.03
See application file for complete search history.

(56) References Cited

U.S. PATENT DOCUMENTS 1,939,699 A * 12/1933 Hofstetter ..... F41A 23/005 89/37.03
2,386,015 A * 10/1945 Thompson ..... B64D 7/02 89/37.11
2,426,498 A * 8/1947 Franklin ..... B25B 5/147 81/91.2
5,767,436 A * 6/1998 Sanderson ..... F41A 21/36 89/37.16
6,283,428 B1 9/2001 Maples et al.
7,415,790 B1 * 8/2008 Ruhland ..... F41A 27/06 89/37.01
7,963,205 B1 * 6/2011 Brooks ..... F41A 27/14 89/37.03
8,578,644 B1 11/2013 Oquin et al.
9,038,524 B2 5/2015 Jebsen et al.
9,046,319 B2 6/2015 Dextraze
(Continued)

OTHER PUBLICATIONS

Tactical Rifleman "How Special Forces setup their Hummer | Mount Weapons | Tactical Rifleman," YouTube, Nov. 24, 2017, pages [retrieved online Jul. 12, 2022 from: www.youtube.com/watch?v=4IK0aQU_8kk].

(Continued)

*Primary Examiner* — Bret Hayes
(74) *Attorney, Agent, or Firm* — Sheridan Ross P.C.

(57) ABSTRACT

A firearm positioning system and methods of use are provided. The system comprises a first arm segment pivotably engaged to a primary body and a second arm segment pivotably engaged to the first arm segment. The system also comprises a cradle pivotably engaged to the second arm segment. The cradle is configured to support a firearm. The cradle comprises a pair of channels at a first end and a backstop assembly at a second end opposite the first end. The pair of channels are configured to receive a front end of a firearm and the backstop assembly is configured to releasably secure a back end of the firearm to the cradle.

18 Claims, 17 Drawing Sheets

(56) References Cited

U.S. PATENT DOCUMENTS

| | | | |
|---|---|---|---|
| 9,056,594 | B2 | 6/2015 | Greenwood et al. |
| 9,316,457 | B2 | 4/2016 | Hagedorn et al. |
| 9,568,267 | B2 | 2/2017 | Lung |
| 9,618,290 | B1 | 4/2017 | Redmon et al. |
| 9,644,916 | B2 | 5/2017 | Hobson |
| 9,689,645 | B2 | 6/2017 | Bouquet |
| 9,702,649 | B1 | 7/2017 | Hoffman et al. |
| 9,733,644 | B2 | 8/2017 | Levien et al. |
| 10,006,735 | B1 | 6/2018 | Hagedorn et al. |
| 10,101,109 | B2 | 10/2018 | Caudle |
| 10,180,296 | B2 | 1/2019 | Polston |
| 10,184,741 | B2 | 1/2019 | Roberts et al. |
| 10,212,876 | B2 | 2/2019 | Aghai et al. |
| 10,309,745 | B2 | 6/2019 | Messinger |
| 10,415,908 | B1 | 10/2019 | Suk et al. |
| 10,502,529 | B2 | 12/2019 | Sammut et al. |
| 10,518,715 | B2 | 12/2019 | Kim et al. |
| 10,739,092 | B2 | 8/2020 | Gritskevitch et al. |
| 10,753,693 | B2 | 8/2020 | Lung et al. |
| 10,782,101 | B2 | 9/2020 | Sabaldan et al. |
| 2008/0092732 | A1* | 4/2008 | Becker ..... F41A 23/20 89/37.03 |
| 2010/0175547 | A1 | 7/2010 | Hoffman |
| 2015/0094046 | A1 | 4/2015 | Jung et al. |
| 2015/0198397 | A1 | 7/2015 | Motley |
| 2016/0216056 | A1* | 7/2016 | Hagedorn ..... F41A 23/005 |
| 2020/0049438 | A1 | 2/2020 | Hatch |
| 2020/0096271 | A1 | 3/2020 | Vito |
| 2020/0256630 | A1 | 8/2020 | Rosenblum et al. |

OTHER PUBLICATIONS

Military Systems Group, Inc. "Machine gun mounts swing arms and turrets firing demo," YouTube, Dec. 10, 2018, pages [retrieved online Jul. 12, 2022 from: www.youtube.com/watch?v=IWvE1qNZmoQ].

* cited by examiner

FIREARM POSITIONING SYSTEMS AND METHODS

RELATED APPLICATIONS

This application claims the benefit of U.S. Provisional Application No. 63/094,804, filed on Oct. 21, 2020, and entitled "Improved Firearm Positioning Systems and Methods", which application is incorporated herein by reference in its entirety.

BACKGROUND

The present disclosure is generally directed to firearm positioning systems, and relates more particularly to a release system for quickly mounting and releasing a firearm.

Firearm mounts are typically used to mount a firearm to a surface. Conventional firearm mounts may require multiple steps to install a firearm to the mount, thereby resulting in delays in mounting a new firearm to a mount or delays in switching firearms. Further, installation of firearms onto conventional mounts may be cumbersome. Conventional firearm mounts are also limited in a quantity of ammunition cans that can be supplied to a firearm, thereby resulting in switching of empty ammunition cans for full ammunition cans more frequently.

SUMMARY

It is one aspect of the present disclosure to provide a system to provide a quick release system for mounting and releasing a firearm that can also support more than one ammunition can. In at least one embodiment, a firearm positioning system adapted for interconnecting a firearm to a framework of a vehicle, the system comprises: a first arm segment pivotably engaged to a primary body, wherein the first arm segment is configured to rotate about a first axis relative to the primary body; a second arm segment pivotably engaged to the first arm segment, wherein the second arm segment is configured to rotate about a second axis relative to the first arm segment; a first release configured to releasably lock movement of the first arm segment relative to the primary body and a second release configured to releasably lock movement of the second arm segment relative to the first arm segment; and a cradle pivotably engaged to the second arm segment, the cradle configured to rotate vertically about an elevation axis relative to the second arm segment, the cradle configured to support a firearm and comprising: a pintle receivable by a socket on the second arm segment, wherein the pintle is rotatable in the socket; a pair of opposing hook arms at a first end of the cradle, the pair of hook arms configured to receive a front end of a firearm; and a backstop assembly at a second end opposite the first end, the backstop assembly configured to releasably secure a back end of the firearm to the cradle.

In at least one embodiment the second arm segment may have a length less than the first arm segment. In some embodiment, the primary body may be an upper portion of a roll-cage of a vehicle. In some embodiments, the backstop assembly may comprise a post and a pin movable from a first position to a second position. The pin may contact the post in a closed position when the pin is in the second position and the pin may not contact the post in an open position when the pin is in the first position. In some embodiments, the pin may be biased to the second position.

In at least one embodiment, the system may further comprise an elevation pin configured to releasably lock the vertical range of motion of the cradle relative to the second arm segment. In some embodiments, the cradle may be configured to support a container. The container may be configured to support at least one ammunition can and is releasably securable to the cradle. In some embodiments, the container may support two ammunition cans.

The container may comprise one or more sliders and the cradle may comprise at least one rail configured to receive the sliders.

In at least one embodiment, a firearm positioning system comprises: a first arm segment pivotably engaged to a primary body; a second arm segment pivotably engaged to the first arm segment; a cradle pivotably engaged to the second arm segment, the cradle configured to support a firearm and a container, the cradle comprising: a removably engaging attachment mechanism positioned at a first end of the cradle, the removably engaging attachment mechanism configured to receive and removably engage a front end of a firearm; a backstop assembly at a second end opposite the first end, the backstop assembly configured to releasably secure a back end of the firearm to the cradle; and at least one rail.

In at least one embodiment, the removably engaging attachment mechanism may comprise a pair of opposing hook arms for engaging the front end of the firearm. In some embodiments, the second arm segment may have a length less than the first arm segment.

The primary body may have an upper portion of a roll-cage of a vehicle. The backstop assembly may comprise a post and a pin movable from a first position to a second position. The pin may contact the post in a closed position when the pin is in the second position and the pin may not contact the post in an open position when the pin is in the first position. The pin may be biased to the second position. The cradle may be adjustable in a vertical range of motion relative to the second arm segment. The system may further comprise an elevation pin configured to releasably lock the vertical range of motion of the cradle relative to the second arm segment. In some embodiments, the container may be configured to support at least one ammunition can and is releasably securable to the cradle. In some embodiments, the container may comprise one or more sliders receivable by the at least one rail.

In at least one embodiment, a method for replacing a first-type firearm with a second-type firearm comprises configuring a first arm segment to engage a primary body about a first axis, the first arm segment rotatable about the first axis relative to the primary body; configuring a cradle to support a first-type firearm and a container holding a plurality of first-type ammunition rounds, the cradle pivotably coupled to a second arm segment, the second arm segment pivotably coupled to the cradle at a first end and pivotably coupled to the first arm segment at a second end, the cradle having a pair of channels a first end to receive a front end of the first-type firearm and a backstop assembly at a second end to releasably secure a back end of the first-type firearm to the cradle; releasing the backstop assembly and removing the first-type firearm from the cradle; replacing the plurality of first-type ammunition rounds with a plurality of second-type ammunition rounds in the container; and configuring the cradle to support a second-type firearm.

It is to be appreciated that any feature described herein can be claimed in combination with any other feature(s) as described herein, regardless of whether the features come from the same described embodiment.

The details of one or more aspects of the disclosure are set forth in the accompanying drawings and the description below. Other features, objects, and advantages of the techniques described in this disclosure will be apparent from the description and drawings, and from the claims.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together. When each one of A, B, and C in the above expressions refers to an element, such as X, Y, and Z, or class of elements, such as X1-Xn, Y1-Ym, and Z1-Zo, the phrase is intended to refer to a single element selected from X, Y, and Z, a combination of elements selected from the same class (e.g., X1 and X2) as well as a combination of elements selected from two or more classes (e.g., Y1 and Zo).

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

The preceding is a simplified summary of the disclosure to provide an understanding of some aspects of the disclosure. This summary is neither an extensive nor exhaustive overview of the disclosure and its various aspects, embodiments, and configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and configurations of the disclosure are possible utilizing, alone or in combination, one or more of the features set forth above or described in detail below.

Numerous additional features and advantages of the present disclosure will become apparent to those skilled in the art upon consideration of the embodiment descriptions provided hereinbelow.

BRIEF DESCRIPTION OF THE DRAWINGS

The accompanying drawings are incorporated into and form a part of the specification to illustrate several examples of the present disclosure. These drawings, together with the description, explain the principles of the disclosure. The drawings simply illustrate preferred and alternative examples of how the disclosure can be made and used and are not to be construed as limiting the disclosure to only the illustrated and described examples. Further features and advantages will become apparent from the following, more detailed, description of the various aspects, embodiments, and configurations of the disclosure, as illustrated by the drawings referenced below.

DETAILED DESCRIPTION

Figure 2:
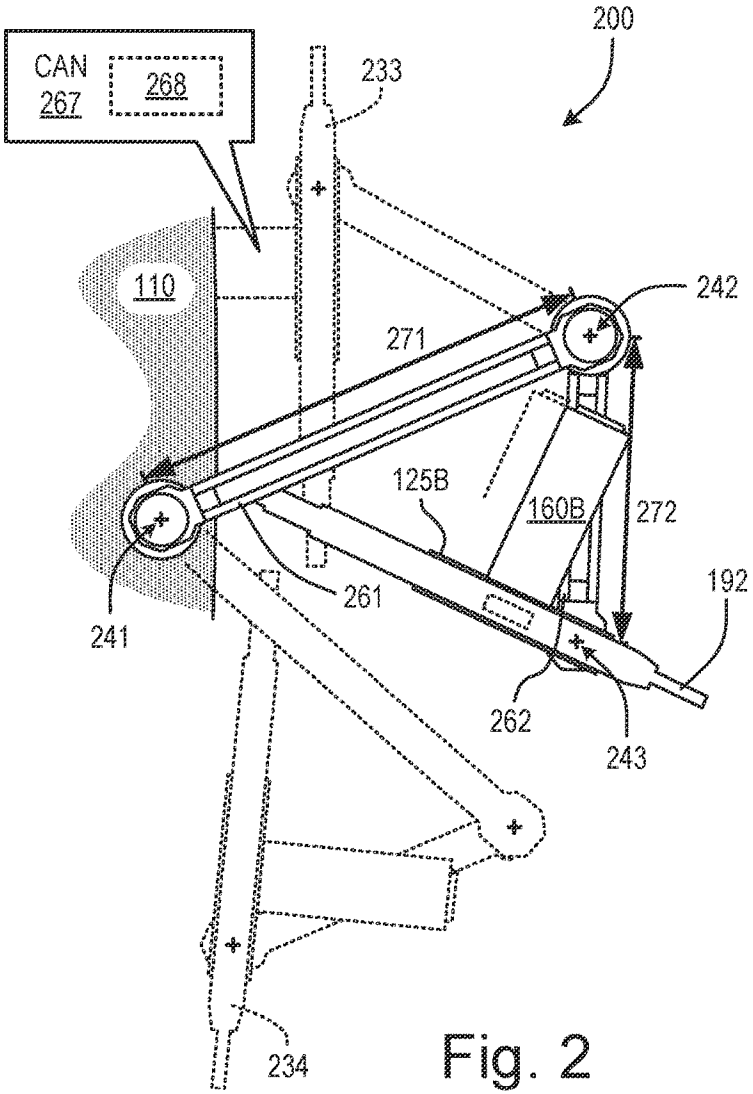
FIG. 2 depicts another weapon positioning system, optionally including that of FIG. 1.

The detailed description that follows is represented largely in terms of processes and symbolic representations of objects or operations. Some of these processes and operations may utilize conventional computer components in a heterogeneous distributed computing environment, including remote file servers, computer servers, and memory storage devices.

It is intended that the terminology used in the description presented below be interpreted in its broadest reasonable manner, even though it is being used in conjunction with a detailed description of certain example embodiments. Although certain terms may be emphasized below, any terminology intended to be interpreted in any restricted manner will be overtly and specifically defined as such.

The phrases "in one embodiment," "in various embodiments," "in some embodiments," and the like are used repeatedly. Such phrases do not necessarily refer to the same embodiment. The terms "comprising," "having," and "including" are synonymous, unless the context dictates otherwise.

"About," "above," "achieved," "adjusting," "aft," "aimed," "allowed," "along," "arranged," "both," "comprising," "configured," "contained," "corresponding," "current," "different," "effective," "endmost," "first," "forward," "from," "high," "implemented," "in light of," "invoked," "less than," "light," "locked," "low," "medium," "mounted," "near," "numerous," "operating," "otherwise," "partly," "positioned," "primary," "readable," "relative," "same," "second," "shorter," "special-purpose," "substantially," "suitable," "wherein," "without," or other such descriptors herein are used in their normal yes-or-no sense, not merely as terms of degree, unless context dictates otherwise. In light of the present disclosure, those skilled in the art will understand from context what is meant by "remote" and by other such positional descriptors used herein. Likewise, they will understand what is meant by "partly based" or other such descriptions of dependent computational variables/signals. "Numerous" as used herein refers to more than two dozen. "Immediate" as used herein refers to having a duration of less than 2 seconds unless context dictates otherwise. Circuitry or data items are "onboard" as used herein if they are aboard a vehicle or denoting or controlled from a facility or feature incorporated into the main circuit board of a computer or computerized device unless context dictates otherwise. Circuitry is "invoked" as used herein if it is called on to undergo voltage state transitions so that digital signals are transmitted therefrom or therethrough unless context dictates otherwise. Software is "invoked" as used herein if it is executed/triggered unless context dictates otherwise. One number is "on the order" of another if they differ by less than an order of magnitude (i.e., by less than a factor of ten) unless context dictates otherwise. One number is "about" equal to another if they differ by less than a factor of two unless context dictates otherwise. As used herein "causing" is not limited to a proximate cause but also enabling, conjoining, or other actual causes of an event or phenomenon. As used herein two entities are "near" one another if they are separated by less than 500 meters, unless context dictates otherwise.

Terms like "processor," "center," "unit," "computer," or other such descriptors herein are used in their normal sense, in reference to an inanimate structure. Such terms do not include any people, irrespective of their location or employment or other association with the thing described, unless context dictates otherwise. "For" is not used to articulate a mere intended purpose in phrases like "circuitry for" or "instruction for," moreover, but is used normally, in descriptively identifying special purpose software or structures.

Reference is now made in detail to the description of the embodiments as illustrated in the drawings. While embodiments are described in connection with the drawings and related descriptions, there is no intent to limit the scope to the embodiments disclosed herein. On the contrary, the intent is to cover all alternatives, modifications and equivalents. In alternate embodiments, additional devices, or combinations of illustrated devices, may be added to, or combined, without limiting the scope to the embodiments disclosed herein.

Figure 1:
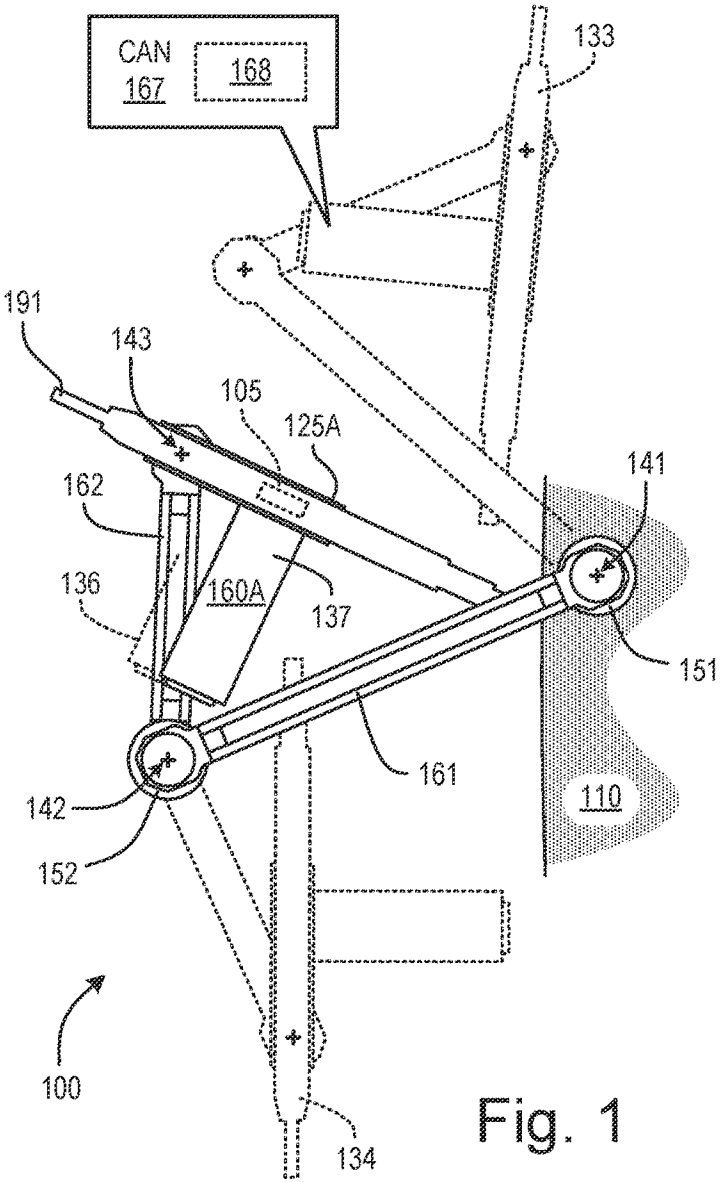
FIG. 1 depicts a weapon positioning system in which one or more improved technologies may be incorporated.

Referring now to FIG. 1, there is shown a weapon positioning system 100 viewed from above. The weapon positioning system 100 is configured to provide for quick mounting and releasing of a firearm to the system 100. Thus, for example, a firearm can be rapidly and easily replaced. The system 100 (and other systems described herein) in particular enables releasing a firearm from the system 100 using one hand, as will be described in detail below.

System 100 comprises a first arm segment 161 configured to pivotably engage a motor vehicle (whether air, land, or water based), tower, or other primary body 110 about a first axis 141 so as to allow the first arm segment 161 to rotate relative to the primary body 110. In some embodiments, the primary body 110 may be a roof or upper portion of a roll cage of a vehicle, or may be attached to a bracket such as brackets 1301 and/or 1302 depicted in FIG. 14 and FIG. 13. System 100 also includes a first cradle 125A configured to support a first ammunition can container 160A and thereby to allow a first-type machine gun 191 (e.g., an M249, M240, or other light/medium machine gun) to be mounted thereon so as to receive first-type ammunition rounds 168 (e.g. 5.56, 7.62, 0.338 mm rounds) from within a first replaceable ammunition can 167 supported by the container 160A. The first ammunition can container 160A has a compartment and is configured to engage the first cradle 125A so as to position the rounds 168 so as to allow the first-type machine gun 191 to draw the numerous ammunition rounds sequentially into a firing chamber 105 thereof.

As shown a second arm segment 162 shorter than the first arm segment by more than 10% is directly or otherwise supported by the first arm segment 161. As shown second arm segment 162 supports the first-type machine gun 191, the first cradle 125A, and the first ammunition can container 160A. The first cradle 125A is also configured to allow the first ammunition can container 160A to slide several centimeters between (the current) aft position 137 at which the ammunition rounds 168 can be drawn into (the chamber 105 of) the first-type machine gun 191 and a more-forward second position 136 that is suitable for use with another type of weapon (e.g., an M240 or other light/medium duty machine gun) but unsuitable for the first-type machine gun 191.

An ancillary positioning mechanism 151 (e.g. comprising a lock or motor) is positioned atop primary body 110 and adjacent first arm segment 161. The mechanism 151 when engaged temporarily prevents a rotation of arm segment 161 relative to primary body 110. Even so, a significant repositioning of machine gun 191 can be achieved by pulling a part of machine gun 191 into a cabin of primary body 110 (e.g. directly below mechanism 151) while the second arm segment 162 pivots around axis 142 (clockwise as shown). This effectuates a turn of more than 90 degrees into an aft-pointing position 134 very rapidly.

Alternatively or additionally, such an ancillary positioning mechanism 151 may be disengaged so as to allow a rotation of arm segment 161 relative to primary body 110 so as to effectuate a substantial turn (i.e. of more than 45 degrees) into a forward-pointing position 133 as well as finer adjustments (e.g. about a primary cradle axis 143) for aiming at a particular target. This can occur, for example, even in a context in which another ancillary positioning mechanism 152 (likewise comprising a lock or motor) temporarily prevents a rotation of the second arm segment 162 relative to the first arm segment 161 (e.g. about axis 142).

Referring now to FIG. 2, there is shown (another instance of) a weapon positioning system 200 that includes the same primary body 110 as well as (an instance of) system 100. System 200 comprises a first arm segment 261 configured to pivotably engage primary body 110 about a first axis 241 so as to allow the first arm segment 261 to rotate relative to the primary body 110. System 200 also includes a second cradle 125B configured to support a second ammunition can container 160B and thereby to allow a second-type machine gun 192 to be mounted thereon so as to receive second-type ammunition rounds 268 (e.g. 7.62, 0.338 mm rounds) from within a second replaceable ammunition can 267 supported by the container 160B. The second ammunition can container 160B has a compartment and is configured to engage the second cradle 125B so as to position the rounds 268 so as to allow the second-type machine gun 192 to draw the numerous ammunition rounds sequentially into a firing chamber 105 of the second-type machine gun 192 even if the first type-rounds 168 would not work at all. (Axes 141-143, 241-243 as shown are all "substantially" vertical, i.e. differing from perfectly vertical by less than 20 degrees).

As shown a second arm segment 262 shorter than the first arm segment by about 30% is directly or otherwise supported by the first arm segment 261 and while supporting the second-type machine gun 192, the second cradle 125B, and the second ammunition can container 160B. The second cradle 125B is also configured to allow the second ammunition can container 160B to slide several centimeters between a rearward (current) position 137 at which the ammunition rounds 268 can be drawn into [the chamber 105 of] the second-type machine gun 192 and a more-forward second position 136 that is suitable for use with another type of weapon but unsuitable for the second-type machine gun 192.

As used herein length-related terms like "shorter" refer to axis-to-axis separations unless context dictates otherwise. Thus the length 271 of segment 261 refers to a nominally horizontal offset between axes 241-242 spanned by segment 261 and the length 272 of segment 262 refers to a nominally horizontal offset between axes 242-243 spanned by segment 262. In some contexts (like that shown) it is helpful for the second segment 262 to be long enough so that a mounted canister 160B as shown cannot impede a rotation of machine gun 192 about axis 243.

Even if an ancillary positioning mechanism (e.g. comprising a lock or motor) temporarily prevents a rotation of arm segment 261 relative to primary body 110, a significant repositioning of machine-gun 192 can be achieved by pulling a part of container 160B into primary body 110 while the second arm segment 262 pivots around axis 242. This effectuates a turn of more than 90 degrees into a forward-pointing position 233.

Alternatively or additionally, such an ancillary positioning mechanism may allow a rotation of arm segment 261 relative to primary body 110 so as to effectuate a substantial turn (i.e. of more than 45 degrees) into an aft-pointing position 234 as well as finer adjustments (e.g. about axis 243) for aiming at a particular target. This can occur, for example, even in a context in which another ancillary positioning mechanism (likewise comprising a lock or motor) temporarily prevents a rotation of the second arm segment 262 relative to the first arm segment 261 (e.g. about axis 242).

It deserves mention that a first-type machine gun 191 can effectively replace the second-type machine gun 192 even in combat just by replacing ammunition can 267 with (an instance of) an ammunition can 167 containing first-type rounds 168; sliding container 160B backward into a suitable position; and swapping out the gun 192 itself. This can occur, for example, in a context in which inventory, positional, or caliber limitations would otherwise prevent system 200 from achieving a desired result. See FIGS. 4-12 and 18.

Figure 3:
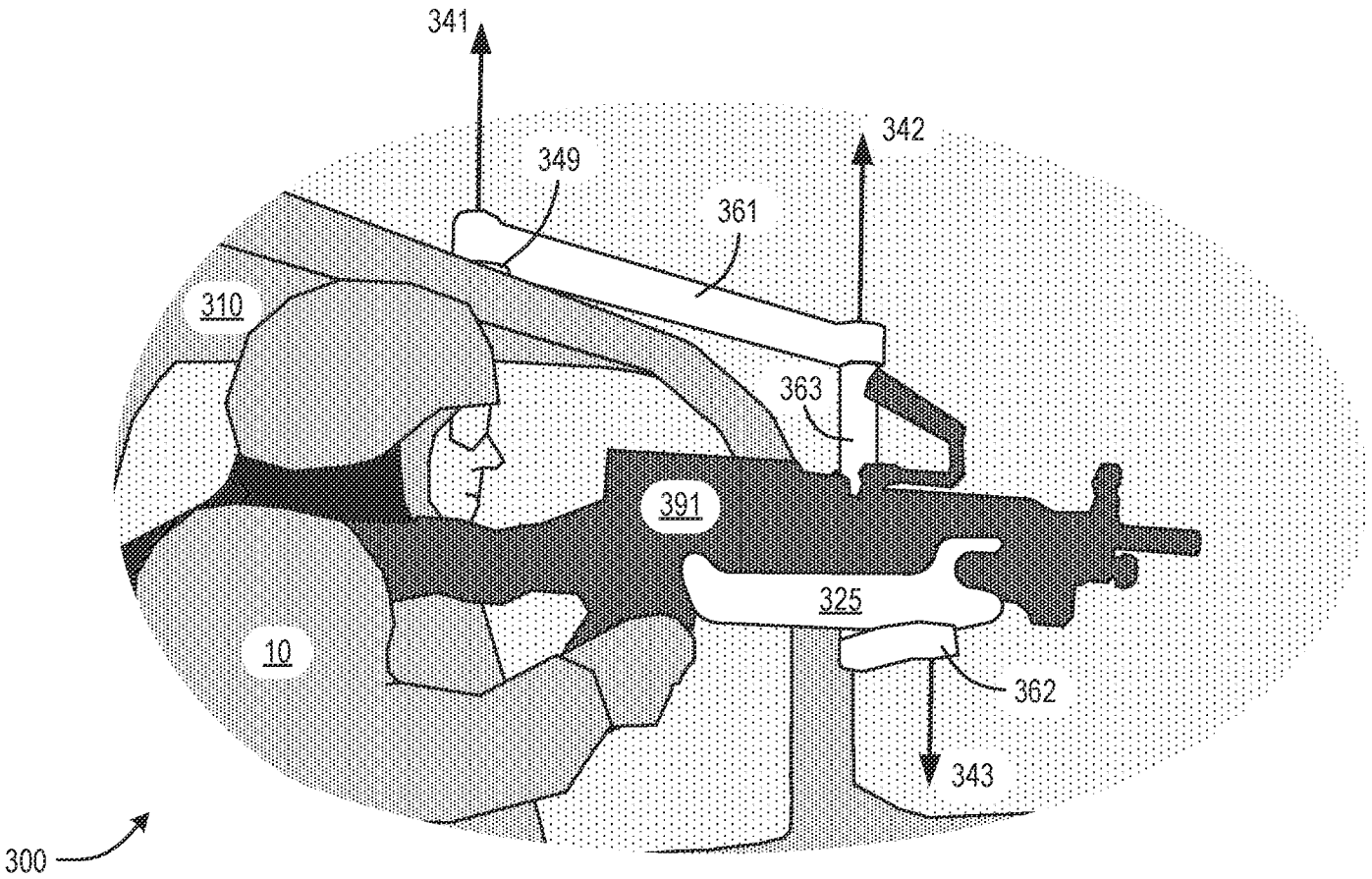
FIG. 3 depicts another weapon positioning system in which one or more improved technologies may be incorporated.

Referring now to FIG. 3, there is shown a weapon positioning system 300 like those described above in which a first arm segment 361 is configured to pivotably engage a helicopter or other motor vehicle 310 about a first (substantially vertical) axis 341 so as to allow the first arm segment 361 to pivot relative to the motor vehicle 310. In some embodiments, the first arm segment 361 is pivotably engaged to a roof or an upper portion of a vehicle such as, for example, a truck, a car, a jeep, a side-by-side, or the like. System 300 also includes a cradle 325 configured to support one or more machine guns 391. A second arm segment 362 shorter than the first arm segment by about 30% is indirectly supported by the first arm segment 361 and pivotably supports (at least) the cradle 325, allowing a human operator 10 to bear less than half of the weight of the gun 391 while aiming (e.g. by rotating about a substantially vertical axis 343 and adjusting pitch) at a target. A substantially vertical member 363 several centimeters tall allows pivoting (e.g. about a substantially vertical axis 342) at a top or bottom end thereof (or both) enabling a socket 349 that joins the first arm segment 361 to the motor vehicle 310 to be effective when installed above a human-occupiable space in which operator 10 is situated.

Figure 4:
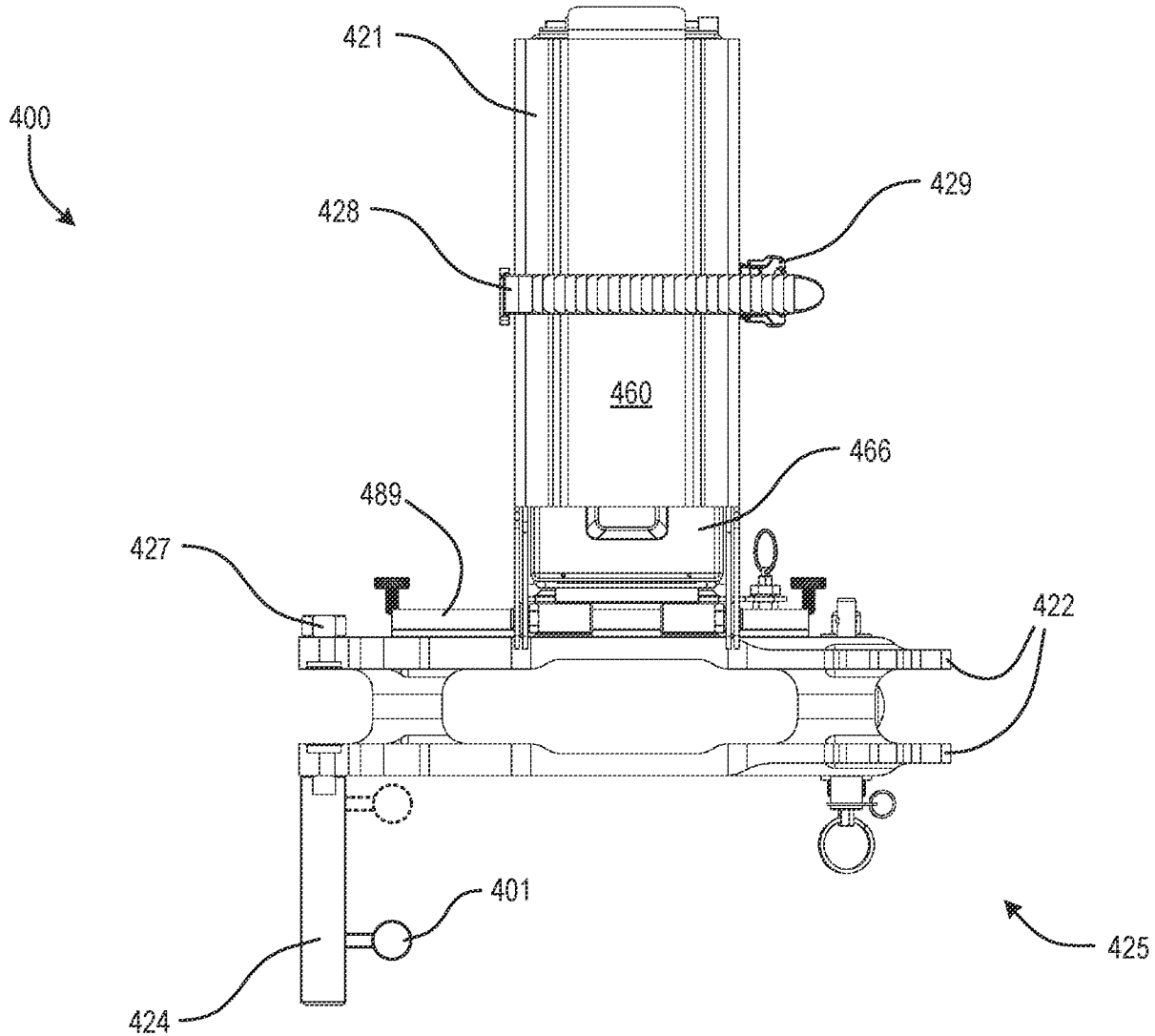
FIG. 4 depicts another weapon positioning system in which one or more improved technologies may be incorporated.

Referring now to FIG. 4, there is shown another weapon positioning system 400 viewed from above. A cradle 425 is configured to allow various machine guns 191, 192 to be mounted with a front end installed in a removably engaging attachment mechanism and then a rear end installed between barrel 424 and backstop post 427 as shown. The backstop post 427 may be magnetic in some embodiments. The removably engaging attachment mechanism may comprise, in some embodiments, a pair of opposing hook arms 422 for engaging the front end of the firearm. The gun is locked into place by moving handle 401 to a locked position like that shown in FIGS. 6-8.

A replaceable ammunition can 167, 267 of an appropriate type is installed into a compartment 466 of a container 460 mounted on cradle 425 as shown. The container lid 421 is secured in place by tightening a ladder strap 428 through buckle 429. Container 460 is positioned by sliding it forward or backward along one or more rails 489 so that ammunition therein is lined up with a firing chamber 105 of the selected gun. Respectively appropriate ammunition rounds can thereby be drawn from within the container 460. This allows the mounted machine gun to draw the ammunition rounds rapidly into its firing chamber 105. In some embodiments, the container lid 421 includes magnets 502 (shown in FIG. 5B) for releasably securing any portion of the ammunition to the container lid 421. For example, an end of an ammunition belt may be secured to the container lid 421 by the magnets 502 during transportation or positioning of the container 460 onto the rails 489.

Figure 5A:
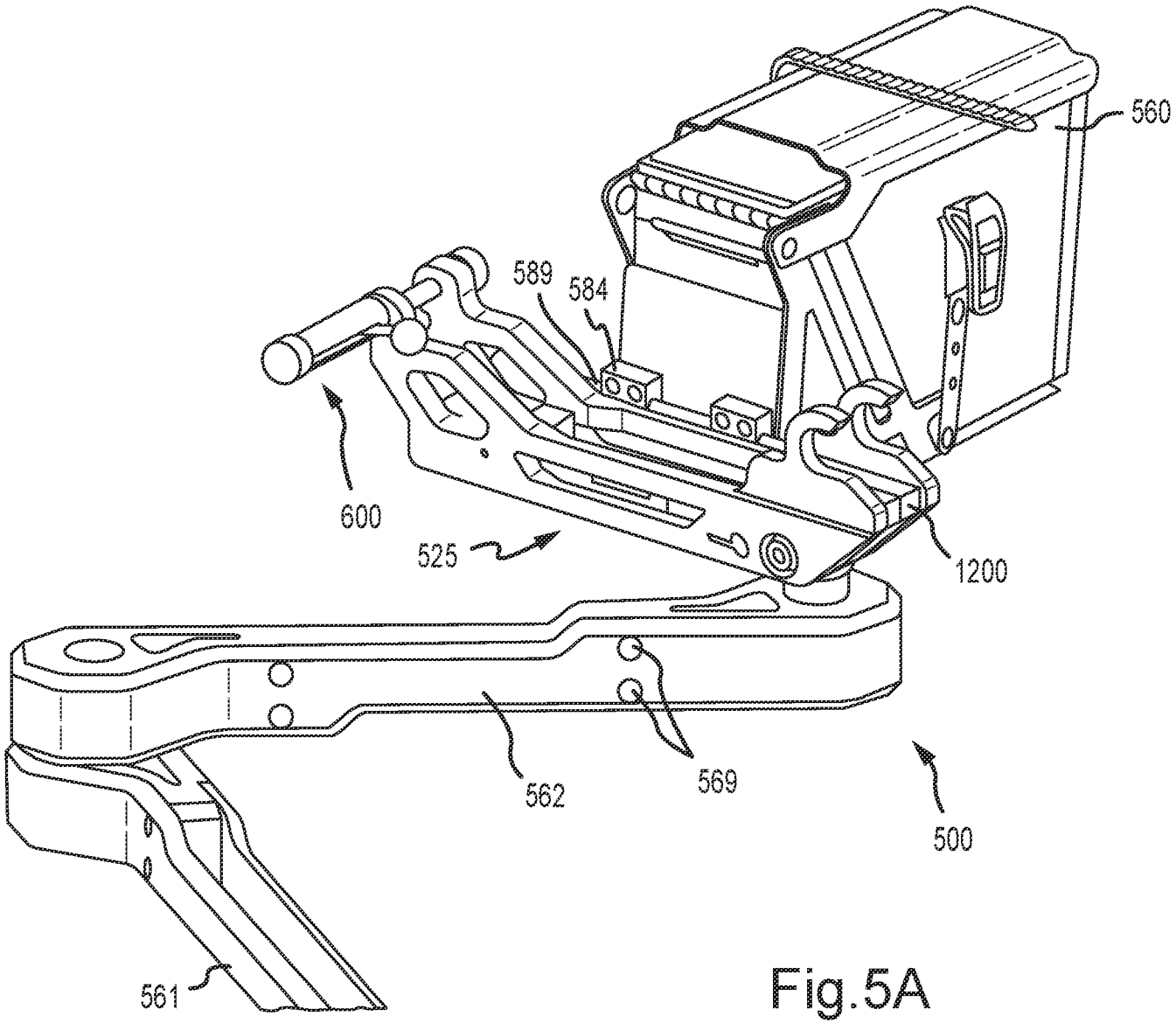
FIG. 5A depicts another weapon positioning system in which one or more improved technologies may be incorporated, resembling those of FIGS. 1-4.

Referring now to FIG. 5A, there is shown a weapon positioning system 500 similar to those described above. System 500 comprises a first arm segment 561 configured to pivotably engage a vehicle, tower, or other primary body 110 about a first axis therebetween so as to allow the first arm segment 561 to rotate relative to the primary body 110. System 500 also includes a cradle 525 supported by a second arm segment 562 and configured to support an ammunition can container 560 and thereby to allow a selected machine gun to be mounted thereon so as to receive correspondingly appropriate ammunition rounds 168, 268 from within the container 560. The container 560 has several sliders 584 configured to engage (one or more rails 589 of) the cradle 525 so as to position the rounds so they can move freely into a firing chamber 105 of the gun. Replaceable expanses of the arms 561, 562 have lengths that are substantially different (i.e. different enough that the effective lengths 271, 272 thereof differ by more than 10%) and can be exchanged in the field by removing and replacing bolts 569 thereof as shown. Cradle 525 also includes a backstop assembly 600, details of which are described with reference to FIGS. 6-8 below. Details about forward cradle assembly 1200 are likewise described below, with reference to FIG. 12.

Figure 5B:
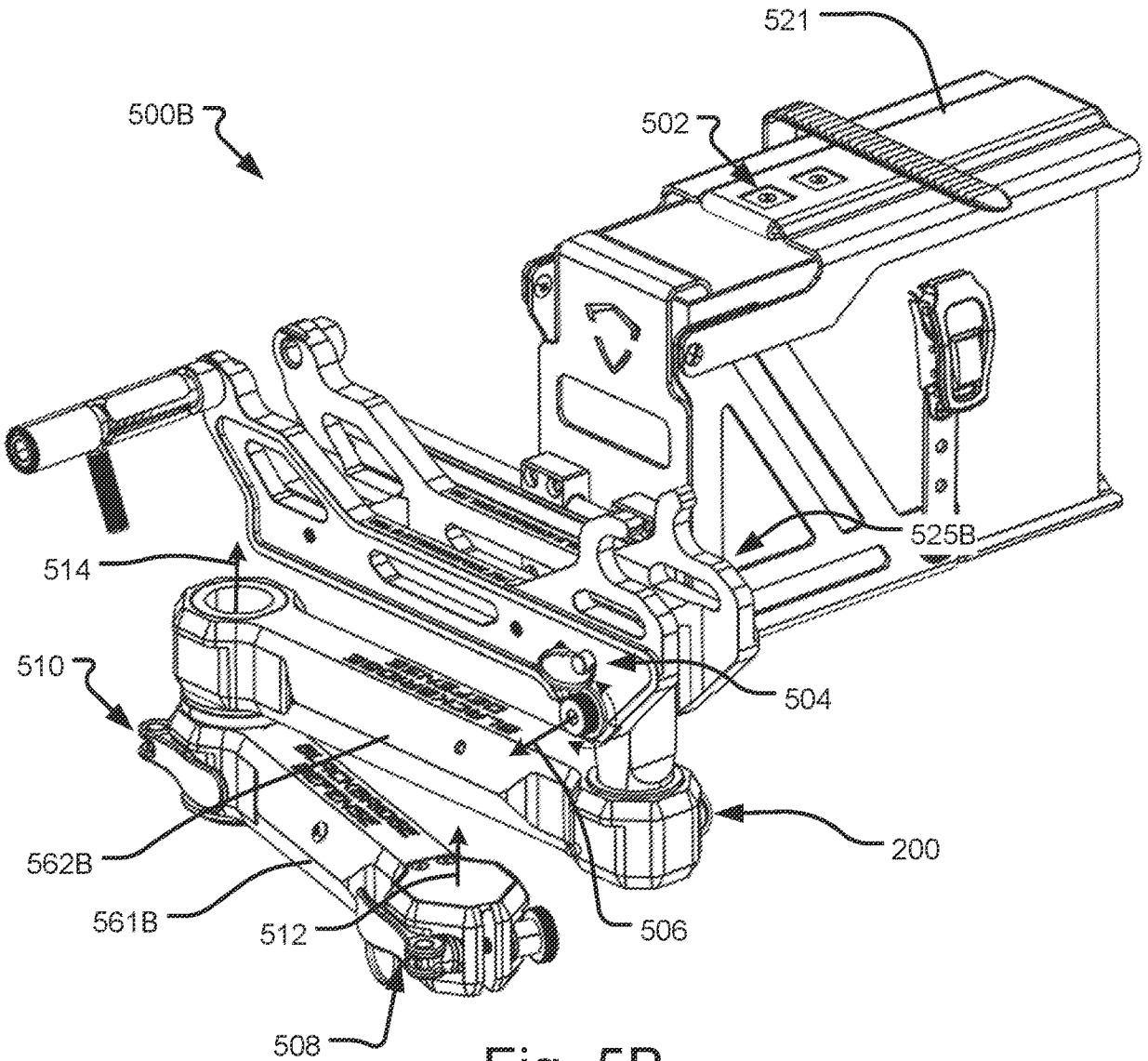
FIG. 5B depicts another weapon positioning system in which one or more improved technologies may be incorporated, resembling those of FIGS. 1-4.
Figure 5C:
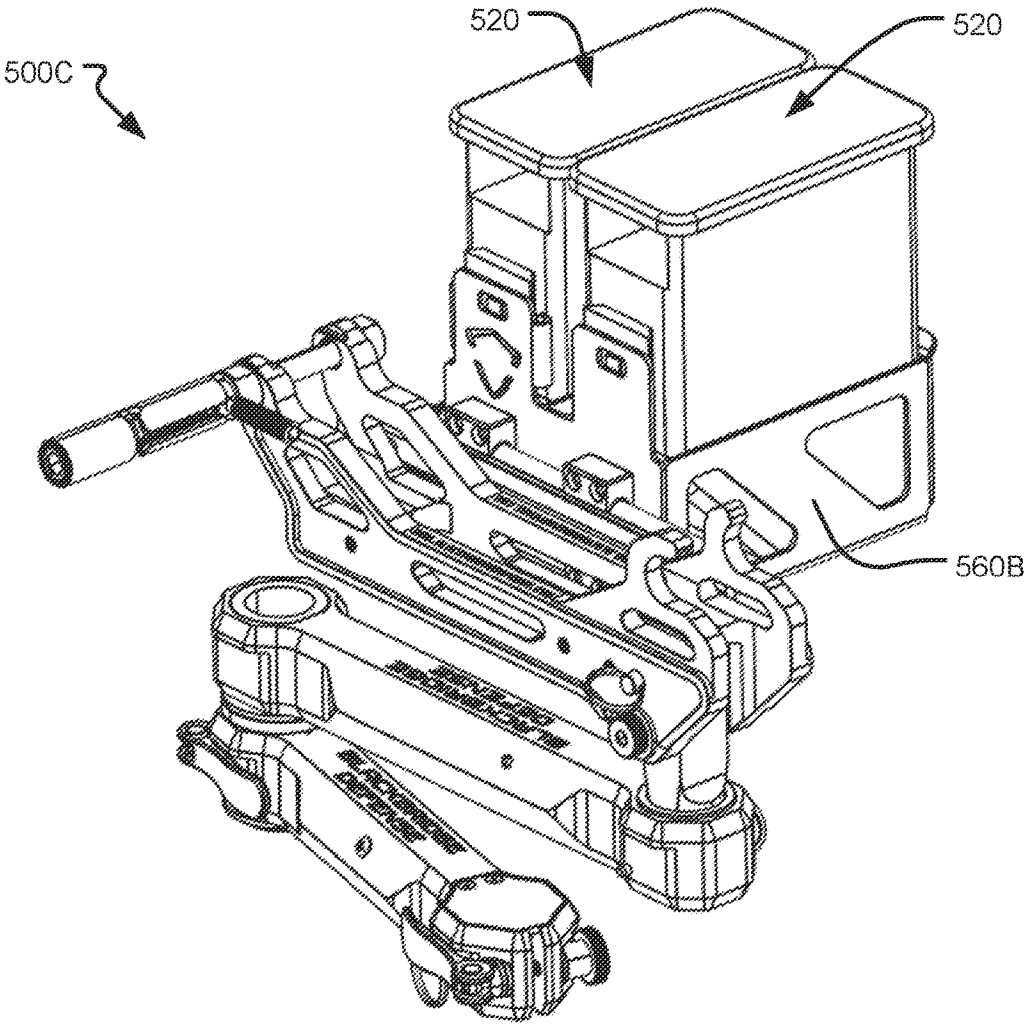
FIG. 5C depicts another weapon positioning system in which one or more improved technologies may be incorporated, resembling those of FIGS. 1-4.

Referring now to FIGS. 5B and 5C, there is shown, respectively, a weapon position system 500B similar to those described above. System 500B is substantially similar to system 500 and includes additional features and components. System 500B includes a container lid 521 comprising one or more magnets 502 for securing at least a portion of an ammunition belt to the container lid 521. For example, an end of an ammunition belt may be secured to the container lid 521 by the magnets 502 during transportation or positioning of the container 521 onto the rails 489, 589A, 589B.

The system 500B also comprises an elevation pin 504 for releasably locking an elevation of a cradle 525B relative to a second arm segment 562. The elevation pin 504 is easily removable from the cradle 525B and controls a vertical range of motion of the cradle 525B (and thus, a firearm mounted to the system 500B). When the elevation pin 504 is removed, the cradle 525B can pivot about an elevation axis 506. When the elevation pin 504 is inserted through the cradle 525B and the pintle, the cradle 525B is locked and cannot rotate about the elevation axis. The elevation pin 504 can be reinstalled at any time such as, for example, during transport.

The system 500B also comprises the first arm segment 561B having a first release 508 and a second release 510. The first release 508 allows for the first arm segment 561B to rotate about the first axis 512 relative to the primary body 101 and the second release 510 allows for the second arm segment 561B to rotate about the second axis 514 relative to the first arm segment 561B. Both the first release 508 and the second release 510 comprise a lever to release, adjust friction, or lock the first arm segment 561B or the second arm segment 562B. The first release 508 and/or the second release 510 may allow a user or operator to adjust a friction tightness or looseness of each of the first arm segment 561B and the second arm segment 562B, respectively. It will be appreciated that in some embodiments, when both the first release 508 and the second release 510 are released, the first arm segment 561B and the second arm segment 562B may both rotate or pivot relative to each other.

Referring now to FIG. 5C, a weapon position system 500C similar to those described above. The weapon position system 500C as illustrated includes a container 560B configured to support, for example, a pair of ammunition cans 520. It will be appreciated that as shown in FIGS. 1, 2, 4, 5A, 5B, and 5D, the weapon position system 500C can be used with different containers such as containers 160A, 160B, 460, 560, and 560B. Further, different containers 160A, 160B, 460, 560, 560B can be swapped using the same system 500C. As previously described, a first container may be removed from the rail 489, 589A, 589B and a second container may be positioned on the rail.

Figure 5E:
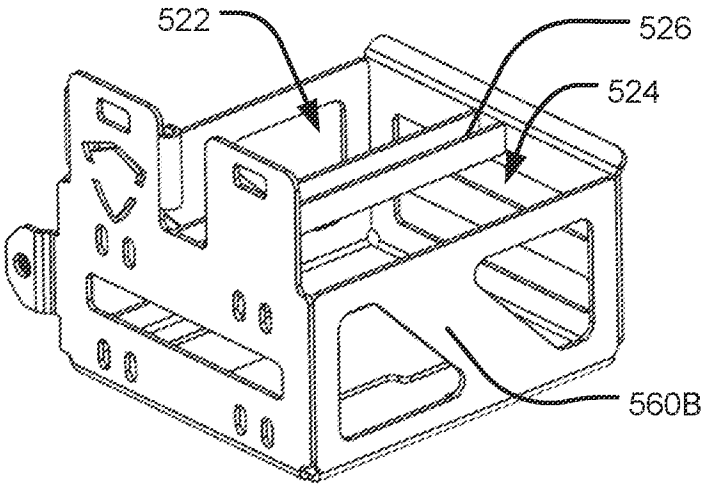
FIG. 5E depicts a second view of the weapons ammunition container of FIG. 5D in which one or more improved technologies may be incorporated.
Figure 5D:
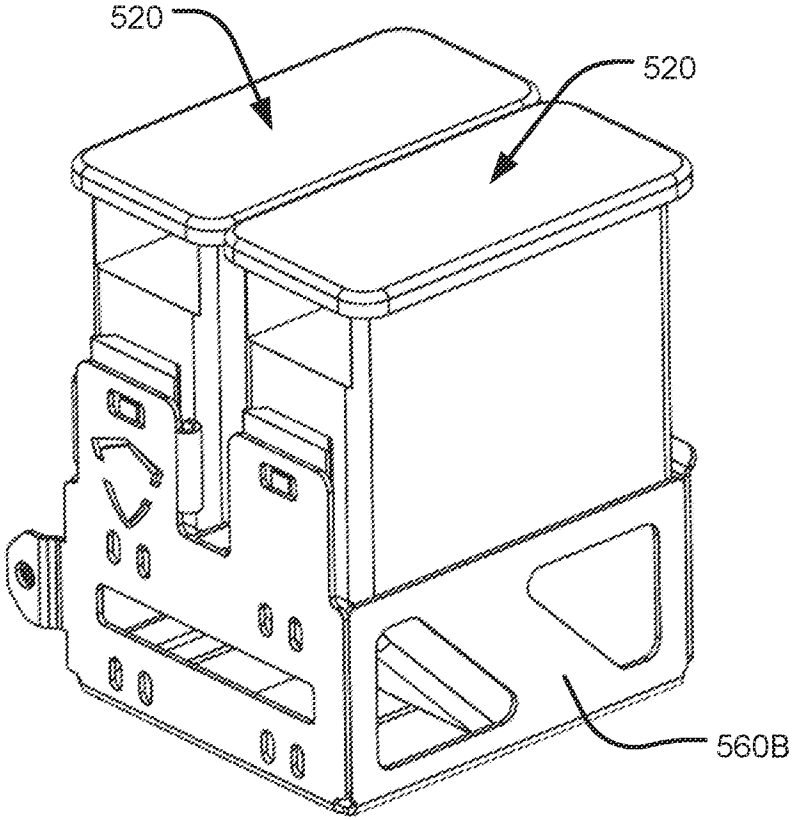
FIG. 5D depicts a first view of another weapons ammunition container in which one or more improved technologies may be incorporated.

Referring now to FIGS. 5D and 5E, the container 560B with the ammunition cans 520 and without the ammunition cans 520 are shown respectively. The container 560B comprises a first receptacle 522 for receiving one of the ammunition cans 520 and a second receptacle 524 for receiving another one of the ammunition cans 520. It will be appreciated that the container 560B may comprise one receptacle, two receptacles, or more than two receptacles for receiving one ammunition can, two ammunition cans, or more than two ammunition cans. The container 560B also comprises a center bracket 526 for separating the first receptacle 522 and the second receptacle 524. It will be appreciated that in some embodiments, the container 560B may not include the center bracket 526 (and may, in some instances, still support two or more ammunition cans).

Figure 8:
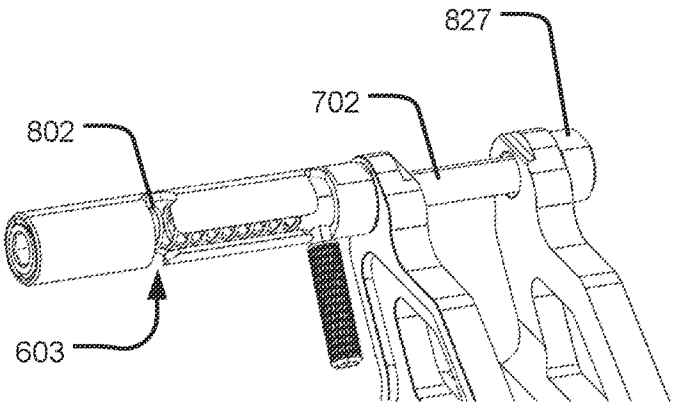
FIG. 8 depicts the backstop assembly of FIG. 6 in a locked position in which one or more improved technologies may be incorporated.
Figure 7:
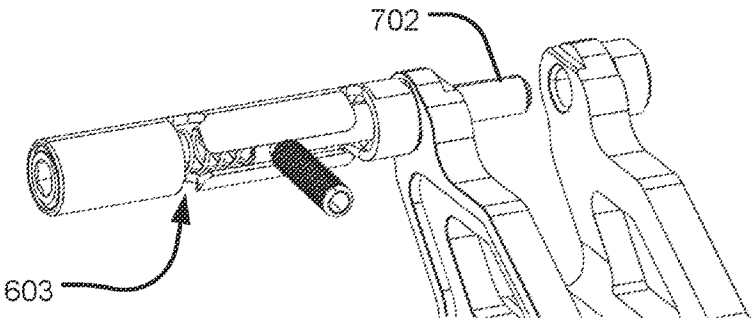
FIG. 7 depicts the backstop assembly of FIG. 6 in a transitional position.
Figure 6:
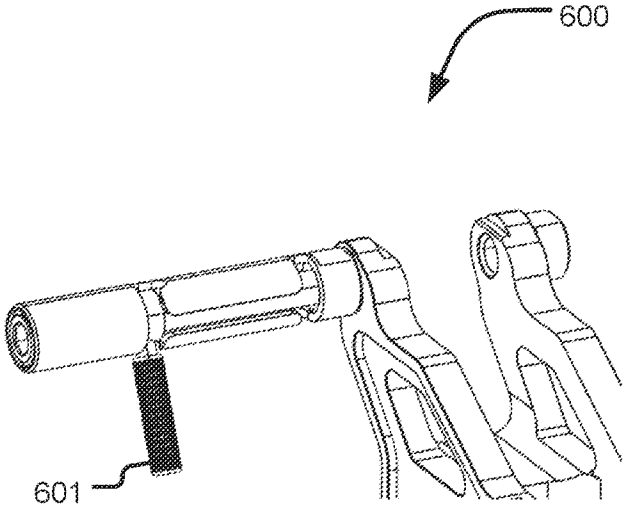
FIG. 6 depicts a backstop assembly of the system of FIG. 5, in which one or more improved technologies may be incorporated.

Referring now to FIGS. 6 to 8, backstop assembly 600 of cradle 525 is shown in a first (open) position, a second (semi-closed) position, and a third (fully closed) position, respectively. With the charging handle 601 in the open position as shown, backstop assembly 600 has released a weapon previously installed and is ready to receive another.

FIG. 7 shows the same backstop assembly 600 in a semi-closed position, extending a pin 702 mechanically coupled with the charging handle 601 to the right as shown. The pin 702, in some embodiments, is ferromagnetic.

FIG. 8 shows the same backstop assembly 600 in a fully closed position, with the pin 702 thereof in contact and magnetic engagement with a post 827 so that the newly-installed weapon (not shown) is secured into the cradle 525. The post 824, in some embodiments, ferromagnetic.

As also shown in FIG. 8, the pin 702 may be biased towards the fully closed position by, for example, a spring 802. The pin 702 may also be operated with one hand, as a user would simply need to move the pin 702 from the third position to the first position by pulling the pin 702 away from the post 827, then rotating the pin 702 such that the handle 601 is moved into a slot 603, thereby locking the pin 702 in the first (open) position. To move the pin 702 from the first (open) position to the third (closed) position, the pin 702 is simply rotated to move the handle 601 out of the slot 603. The spring 802 (or any mechanism by which to bias the pin 702) then applies a force to move the pin 702 to the third position. It will be appreciated that in some embodiments the handle 601 may also be held in a second slot to hold the pin 702 in the third position. For example, in some embodiments, the pin 702 may not be biased and the pin 702 may be locked by way of rotating the handle 601 into the second slot.

Figure 9:
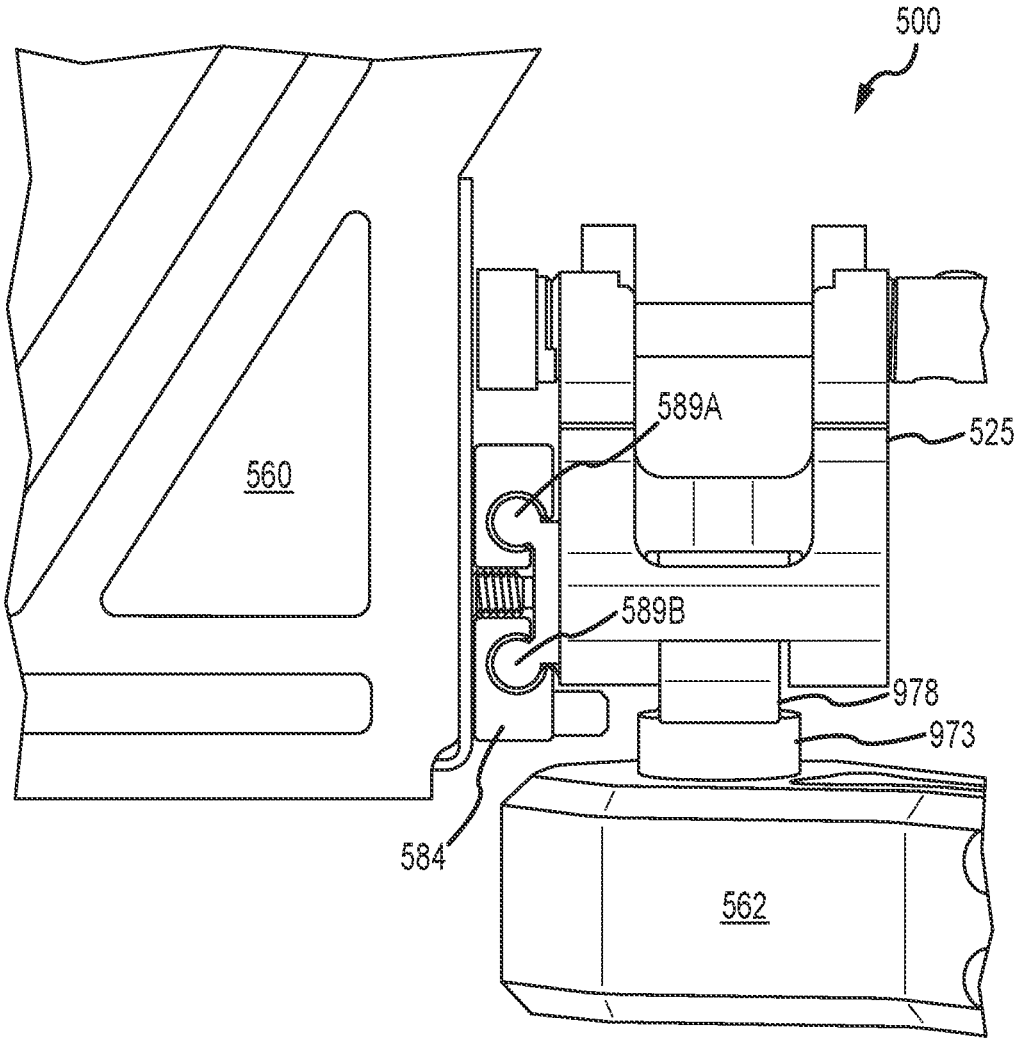
FIG. 9 depicts a rear view of the weapon positioning system of FIG. 5 in which one or more improved technologies may be incorporated.

Referring now to FIG. 9, there is shown a rear view of weapon positioning system 500 where the second arm segment 562 and the ammunition can container 560 both engage the cradle 525. When unlocked the cradle 525 is pivotable about a substantially vertical axis (like axis 343) by virtue of a rotatable pintle 973 that extends down into (a socket of an endmost portion of) segment 562. When unlocked the cradle 525 also has an adjustable pitch by virtue of hinge 978. The ammunition can container 560 also has several sliders 584 that engage rails 589A-B of the cradle 525, allowing for sliding engagement between the container 560 and cradle 525 when unlocked.

Figure 10:
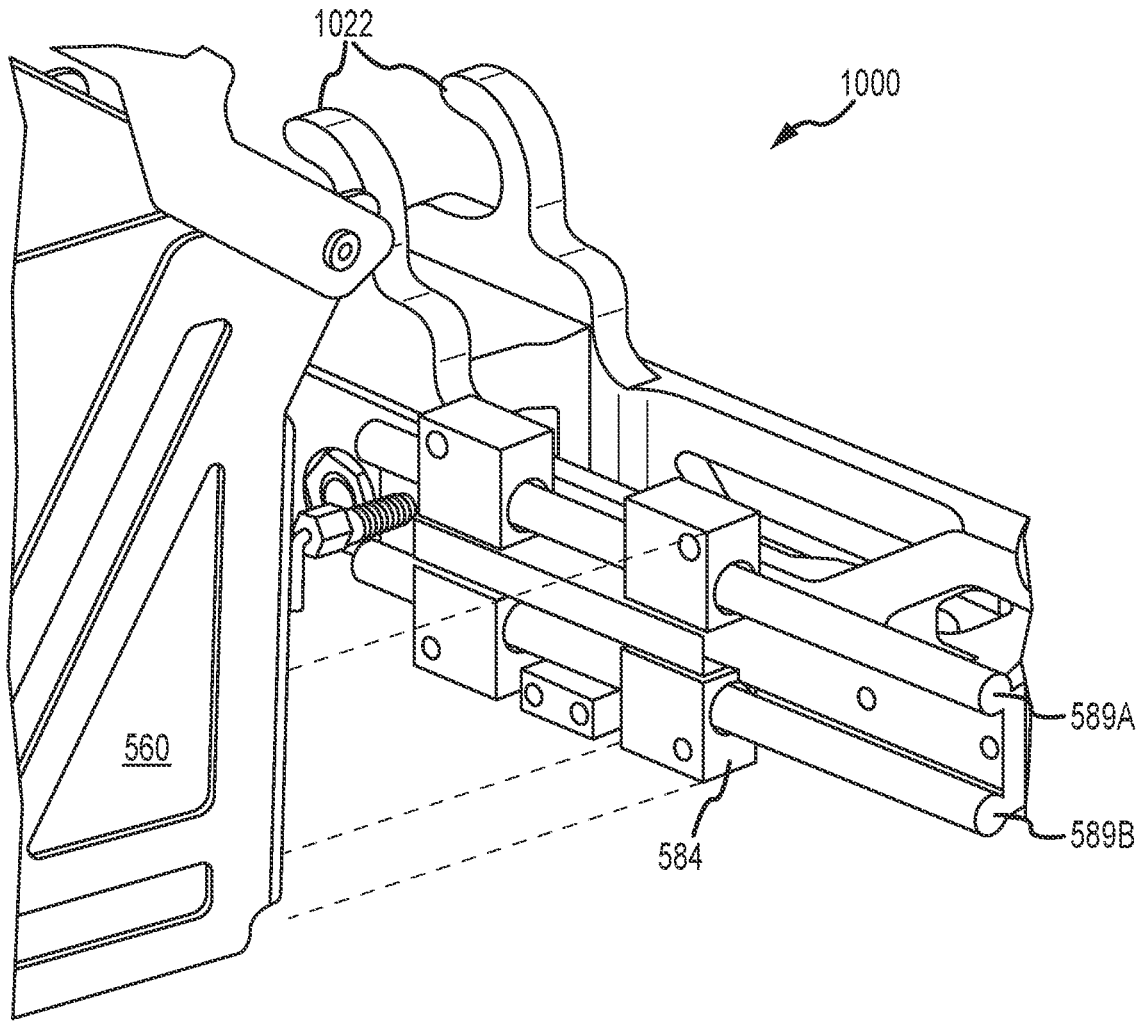
FIG. 10 depicts a breakaway oblique view of part of the weapon positioning system of FIG. 5 in which one or more improved technologies may be incorporated.

Referring now to FIG. 10, there is shown an oblique breakaway view of the rail assembly 1000 of weapon positioning system 500. Sliders 584 affixed to the ammunition can container 560 can slide along rails 589A-B of the cradle 525. As shown, the sliders 584 are near the front of the cradle where opposing hook arms 1022 stand ready to receive the front end of a machine gun.

Figure 11:
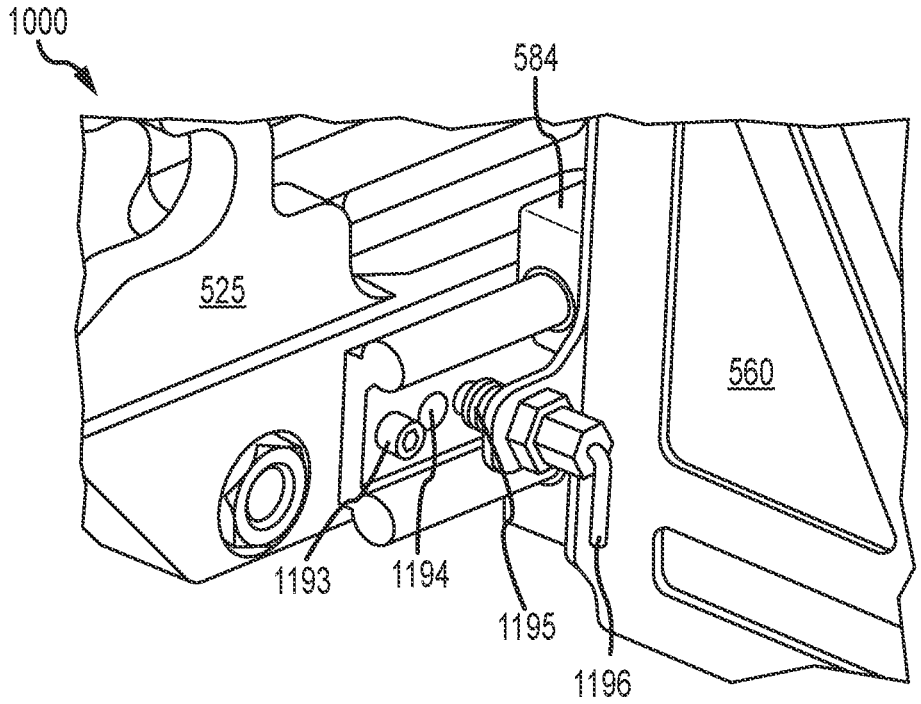
FIG. 11 depicts another oblique view of part of the weapon ammunition container positioning system of FIG. 5 in which one or more improved technologies may be incorporated.

Referring now to FIG. 11, there is shown another oblique view of the rail assembly 1000 by which ammunition can container 560 engages cradle 525. In addition to the several sliders 584, container 560 also has a retractable lockout pin 1196 that is urged toward cradle 525 by a spring 1195. As an unlocked container 560 slides forward (i.e. leftward as shown) it can become locked into a forward alignment position as the pin 1196 reaches and enters an alignment hole 1194 that determines the position. (See position 136 in FIG. 1.) Opposite limits of the range of motion of the container 560 are determined by pin 1196 reaching a respective track bump-stop 1193 at each end as shown. Once locked, the container can be unlocked and begin another sliding motion by operator 10 pulling pin 1196 out of its alignment hole 1194.

Figure 12B:
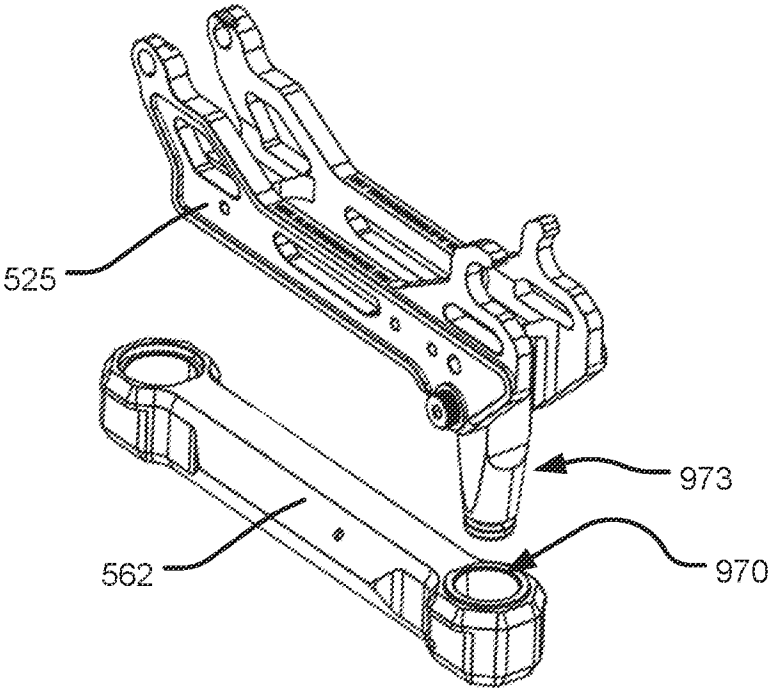
FIG. 12B depicts a cradle assembly and a second arm segment in which one or more improved technologies may be incorporated.
Figure 12A:
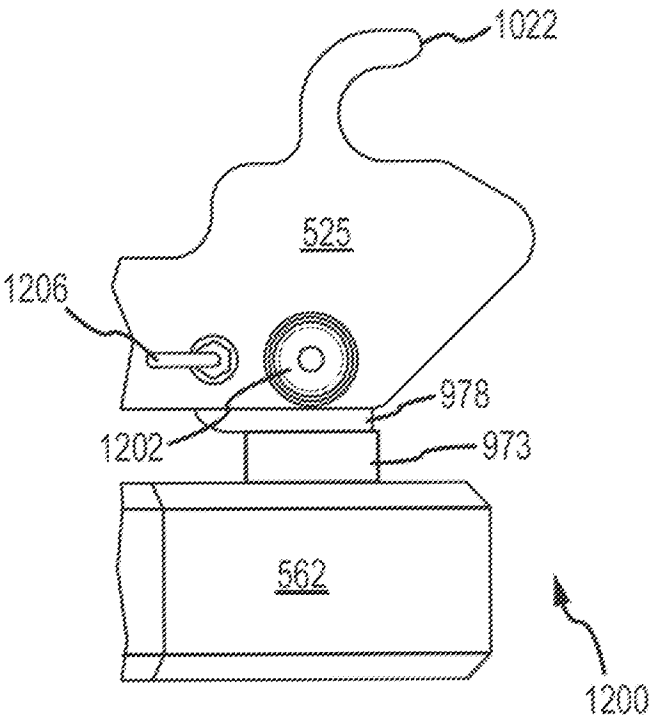
FIG. 12A depicts a cradle assembly of the system of FIG. 5, in which one or more improved technologies may be incorporated.

Referring now to FIGS. 12A and 12B, there is shown a side view of the forward cradle assembly 1200 where the second arm segment 562 engages the cradle 525 and a view of the cradle 525 separated from the second arm segment 562. The pintle 973 (fully visible in FIG. 12B) is rotatable and extends down into a socket 970 of an endmost portion of arm segment 562. Pintle 973 is connected to cradle 525 via a hinge 978 and pintle securement bolt 1202. A pitch adjustment lockout pin 1206 allows an operator 10 to enable gun pitch adjustment (e.g. when the gun is in use) or to prevent gun pitch adjustment (e.g. during transport or storage). The pintle 516 allows for easy and quick attachment and detachment of the cradle 525B to the second arm segment 562B. The pintle 516 can be secured to the opening 518 by a pin such as the pin 200 shown in FIG. 5B.

Figure 13:
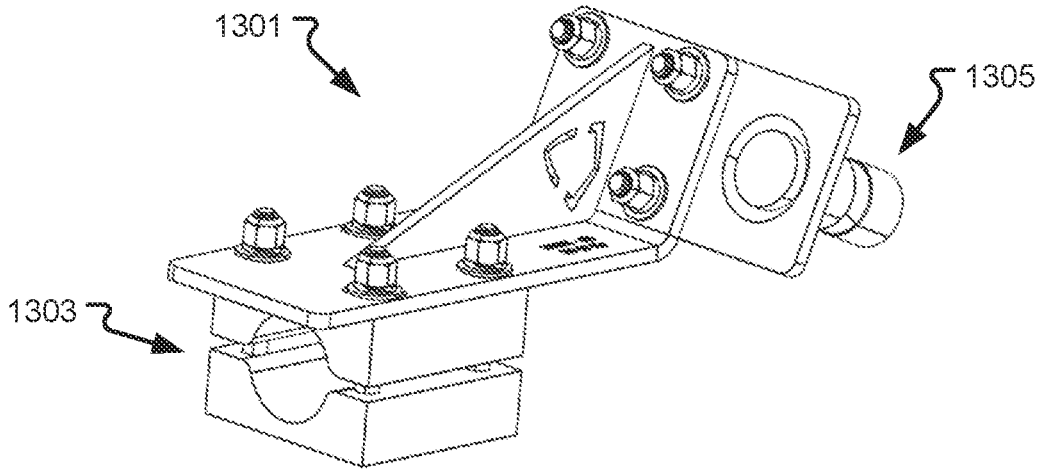
FIG. 13 depicts a first bracket in which one or more improved technologies may be incorporated.
Figure 14:
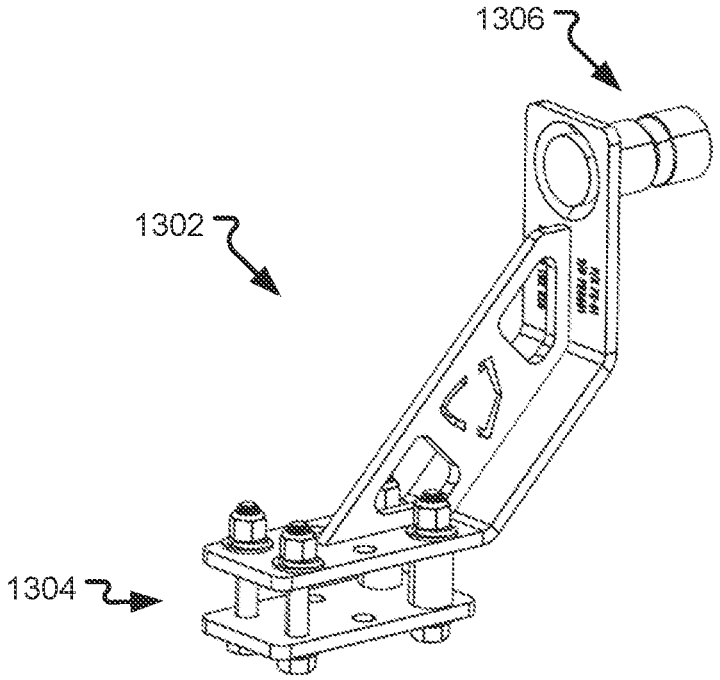
FIG. 14 depicts a second bracket in which one or more improved technologies may be incorporated.

Referring now to FIGS. 13 and 14, a first bracket 1301 and a second bracket 1302, are respectively shown. The first bracket 1301 and the second bracket 1302 are configured to secure the system 100, 200, 300, 400, 500, 500B, 500C, to the primary body 101 in some applications. For example, the first bracket 1301 and the second bracket 1302 may secure the system 100, 200, 300, 400, 500, 500B, 500C to a side-by-side vehicle. It will be appreciated that in some embodiments, the system 100, 200, 300, 400, 500, 500B, 500C can be directly mounted to the primary body 101 without the first bracket 1301 and/or the second bracket 1302. The first bracket 1301 and the second bracket 1302 each comprise a first mounting member 1303, 1304, respectively, for attachment to a primary body 101 and a second mounting member 1305, 1306, respectively, for attachment to the system 100, 200, 300, 400, 500, 500B, 500C. As shown in the illustrated embodiments, the first mounting member 1303 comprises a clamp for securing the bracket to a tube such as, for example, a tube of a roll cage and the first mounting member 1304 comprises a platform that can be, for example, bolted to a body of, for example, a vehicle. As further shown, the second mounting members 1305, 1306 each comprise a pintle receivable by a receiver such as an opening formed on the first arm segment 561, the second arm segment 562, the cradle 525, or any component of the system 100, 200, 300, 400, 500, 500B, 500C. It will be appreciated that the first mounting member 1303, 1304 and/or the second mounting member 1305, 1306 may be secured to the primary body 101 or the system 100, 200, 300, 400, 500, 500B, 500C, respectively, using any mounting mechanism such as, but not limited to, clamps, bolts, adhesion, rivets, cable ties, or the like.

Figure 15:
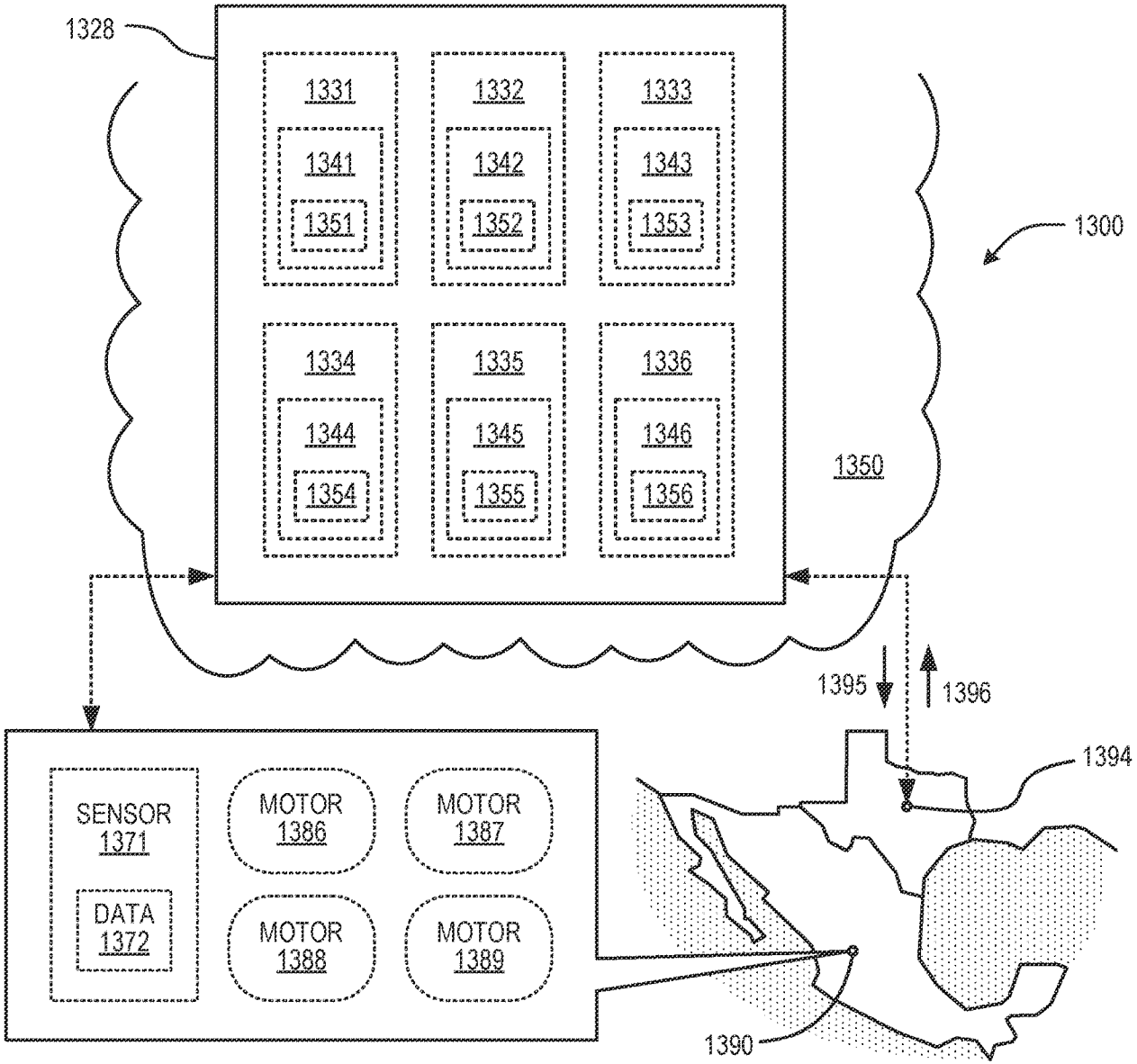
FIG. 15 depicts a remote coordination context in which one or more improved technologies may be incorporated.

FIG. 15 schematically illustrates one or more distributed or other data-handling media 1300 configured to facilitate remote coordination and comprising transistor-based circuitry 1328 in one or more data networks 1350, in which one or more technologies may be implemented. In the interest of concision and according to standard usage in information management technologies, the functional attributes of modules described herein are set forth in natural language expressions. It will be understood by those skilled in the art that such expressions (functions or acts recited in English, e.g.) adequately describe structures identified below so that no undue experimentation will be required for their implementation. For example, any session parameters or other informational data identified herein may easily be represented digitally as a voltage configuration on one or more electrical nodes (conductive pads of an integrated circuit, e.g.) of an event-sequencing structure without any undue experimentation. Each electrical node is highly conductive, having a corresponding nominal voltage level that is spatially uniform generally throughout the node (within a device or local system as described herein, e.g.) at relevant times (at clock transitions, e.g.). Such nodes (lines on an integrated circuit or circuit board, e.g.) may each comprise a forked or other signal path adjacent one or more transistors. Moreover, many Boolean values (yes-or-no decisions, e.g.) may each be manifested as either a "low" or "high" voltage, for example, according to a complementary metal-oxide-semiconductor (CMOS), emitter-coupled logic (ECL), or other common semiconductor configuration protocol. In some contexts, for example, one skilled in the art will recognize an "electrical node set" as used herein in reference to one or more electrically conductive nodes upon which a voltage configuration (of one voltage at each node, for example, with each voltage characterized as either high or low) manifests a yes/no decision or other digital data.

Such circuitry 1328 may comprise one or more integrated circuits (ICs), for example, optionally mounted on one or more circuit boards. Whether implemented in a distributed cloud or within one or more local systems described herein, transistor-based circuitry 1328 comprises an event-sequencing structure generally as described in U.S. Pat. Pub. No. 2015/0094046 but configured as described herein. Transistor-based circuitry 1328 may (optionally) include one or more instances of interface modules 1331 configured to facilitate remote interactions such as operational data 1395 from one or more operators 10 or systems 100, 200, 300, 400, 500 of a coordinated force 1390 (e.g. in Mexico) transmitted to a remote support facility 1394 (e.g. in Texas). As used herein "remote" refers to any component or other asset in communication across a distance of more than 1 kilometer from a gun support cradle 125, 325, 425, 525 deployed for a security concern in regard to a system that includes the cradle. This can occur, for example, in a context in which one or more operators 10 or other onsite technicians "locally" configure several motor vehicles 310 or other primary bodies 110 as described herein with several instances of machine guns 191, 192, 391 and weapon positioning systems 100, 200, 300, 400, 500.

Alternatively or additionally such interactions may include feedback 1396 (e.g. recommendations or instructions) from the support facility 1394. Such an interface module 1331 may include one or more electrical node sets 1341 upon which informational data is represented digitally as a corresponding voltage configuration 1351. Transistor-based circuitry 1328 may likewise include one or more instances of linking modules 1332 that make data associations as described herein, for example, each including an electrical node set 1342 upon which informational data is represented digitally as a corresponding voltage configuration 1352. Transistor-based circuitry 1328 may likewise (optionally) include one or more instances of invocation modules 1333 that initiate operations as described herein, for example, each including an electrical node set 1343 upon which informational data is represented digitally as a corresponding voltage configuration 1353. Transistor-based circuitry 1328 may likewise include one or more instances of control modules 1334 that manage controllers and other subsystems as described herein, for example, each including an electrical node set 1344 upon which informational data is represented digitally as a corresponding voltage configuration 1354. Transistor-based circuitry 1328 may likewise (optionally) include one or more instances of recognition modules 1335 that detect conditions and criteria as described herein, for example, each including an electrical node set 1345 upon which informational data is represented digitally as a corresponding voltage configuration 1355. Transistor-based circuitry 1328 may likewise include one or more instances of response modules 1336 that implement protocols as described herein, for example, each including an electrical node set 1346 upon which informational data is represented digitally as a corresponding voltage configuration 1356.

To fulfill operations described herein, moreover, implementations of systems 100, 200, 300, 400, 500 that comprise motor vehicles 310 or other primary bodies 110 may each include one or more cameras or other sensors 1371 configured to capture and process photographic or other sensor data 1372. In some contexts such a camera may be mounted below a gun barrel or wireless (or both).

Alternatively or additionally such systems 100, 200, 300, 400, 500 mounted upon such bodies 110 may (optionally) include (instances of) position control motors 1386-1389. For sufficiently heavy weapons, one or more of these motors may comprise a hydraulic slew or worm gears.

Figure 16:
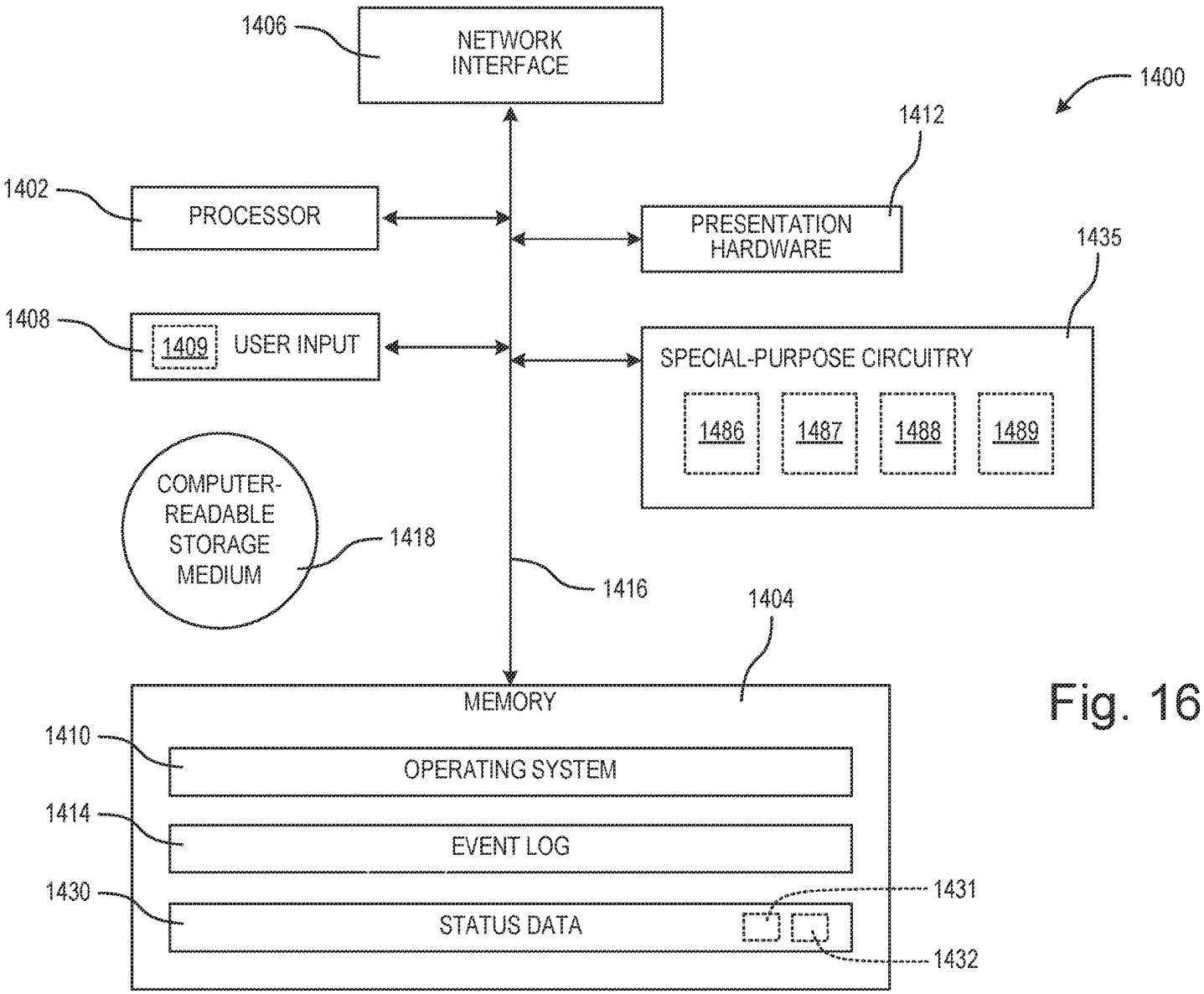
FIG. 16 schematically depicts a client device in which one or more improved technologies may be incorporated.

Referring now to FIG. 16, there is shown a client device 1400 in which one or more technologies may be implemented. Client device 1400 may include one or more instances of processors 1402, of memories 1404, user inputs 1408, and of (speakers, displays, or other) presentation hardware 1412 all interconnected along with the network interface 1406 via a bus 1416. This can occur, for example, in a context in which such user input 1408 includes keyed-in data from an operator 10 or other indications 1409 of user preference. One or more network interfaces 1406 allow device 1400 to connect via the Internet or other networks 150). Memory 1404 generally comprises a random-access memory ("RAM"), a read only memory ("ROM"), and a permanent mass storage device, such as a disk drive. Memory 1404 may contain one or more instances of operating systems 1410, of an event log 141 (including onboard sensor data 1372), of status data 1430, or of other modules that facilitate operations described herein. This can occur, for example, in a context in which status data 1430 includes a first-type ammunition inventory 1431 indicating rounds 168 remaining in a corresponding ammunition can 167 or a second-type ammunition inventory 1432 indicating rounds 268 remaining in a corresponding ammunition can 267 (or both).

These and other software components may be loaded from a non-transitory computer readable storage medium 1418 into memory 1404 of the client device 1400 using a drive mechanism (not shown) associated with a non-transitory computer readable storage medium 1418, such as a floppy disc, tape, DVD/CD-ROM drive, flash card, memory card, or the like. In some embodiments, software or other digital components may be loaded via the network interface 1406, rather than via a computer readable storage medium 1418. Special-purpose circuitry 1435 may, in some variants, include motor controllers 1486-1489 aboard a vehicle or other primary body 110, 310. This can occur, for example, in a context in which motor controller 1486 (via a corresponding motor 1386) is configured to control a rotary position of a first arm 161, 261, 361, 561 relative to a primary body that supports it; in which motor controller 1487 (via a corresponding motor 1387) is configured to control a rotary position of a second arm 162, 262, 362, 562 relative to a corresponding first arm; in which motor controller 1488 (via a corresponding motor 1388) is configured to control a rotary position of a cradle 125, 325, 425, 525 on which a gun is mounted; and in which motor controller 1489 (via a corresponding motor 1389) is configured to control a pitch of the same cradle 125, 325, 425, 525. Special-purpose circuitry 1435 may likewise include some or all of modules 1331-1336 or other event-sequencing logic described herein. In some embodiments client device 1400 may include many more components than those shown in FIG. 16, but it is not necessary that all conventional components of a mobile device be shown in order to disclose an illustrative embodiment.

Figure 17:
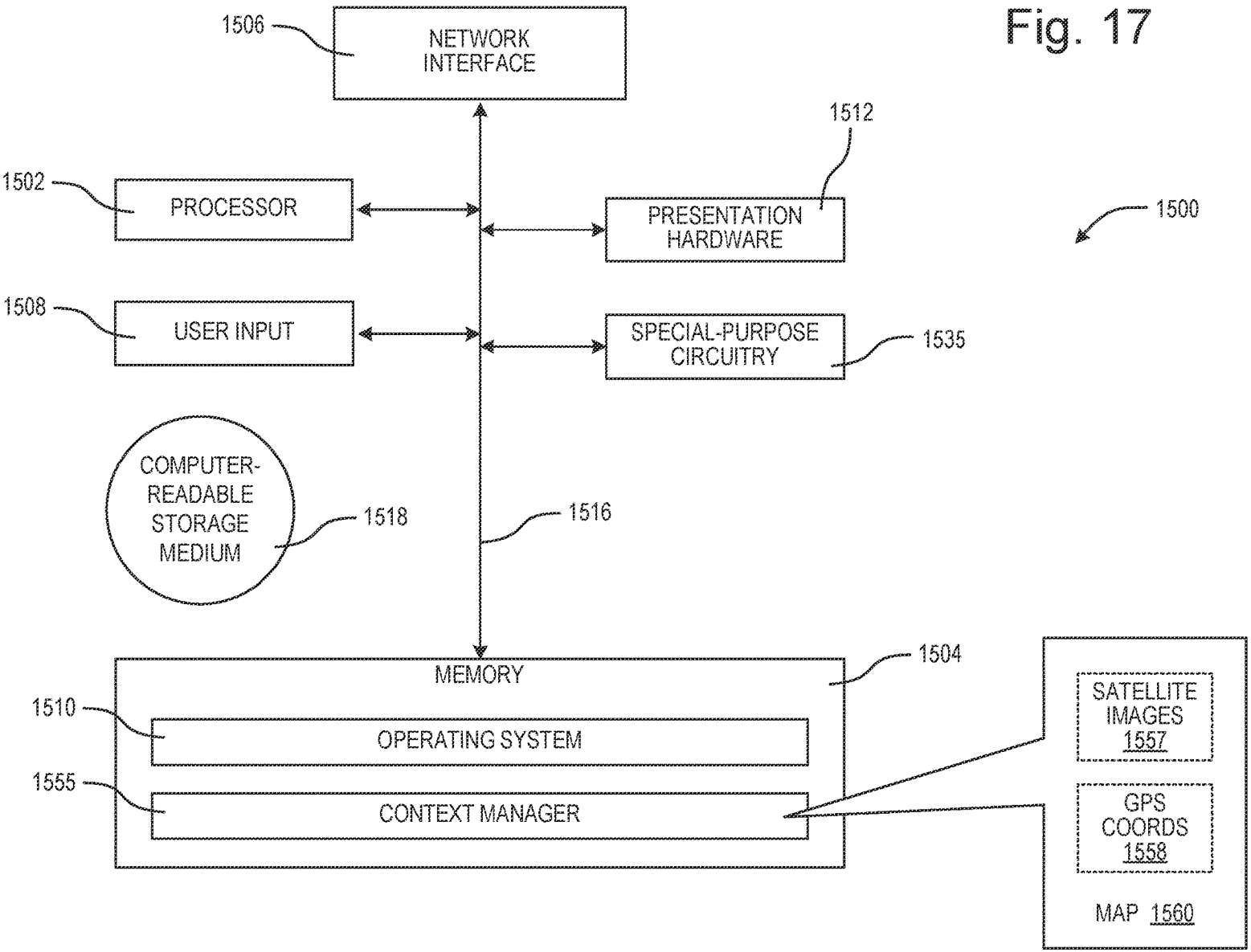
FIG. 17 schematically depicts a server in which one or more improved technologies may be incorporated.

Referring now to FIG. 17, there is shown a server 1500 in which one or more technologies may be implemented. Server 1500 may include one or more instances of processors 1502, of memories 1504, user inputs 1508, and of (speakers or other) presentation hardware 1512 all interconnected along with the network interface 1506 via a bus 1516. One or more network interfaces 1506 allow server 1500 to connect via the Internet or other networks 150). Memory 1504 generally comprises a random access memory ("RAM"), a read only memory ("ROM"), and a permanent mass storage device, such as a disk drive.

Memory 1504 may contain one or more instances of operating systems 1510, of websites 1514, of aggregation modules 1526, or of media preference affinity services or other such scoring modules that facilitate modeling the preferences of a user/member. These and other software components may be loaded from a non-transitory computer readable storage medium 1518 into memory 1504 of the server 1500 using a drive mechanism (not shown) associated with a non-transitory computer readable storage medium 1518, such as a floppy disc, tape, DVD/CD-ROM drive, flash card, memory card, or the like. In some embodiments, software or other digital components may be loaded via the network interface 1506, rather than via a computer readable storage medium 1518. Alternatively or additionally, memory 1504 may include a context manager 1555 that takes into account a map 1560 that depicts one or more current satellite images 1557 (i.e. less than one day old and depicting potentially hostile forces near the motor vehicle 310 or other primary body 110) and global positioning system coordinates 1558 thereof as described herein. Special-purpose circuitry 1535 may, in some variants, include a neural network configured to facilitate an optimal situational response or other event-sequencing logic described herein. In some embodiments server 1500 may include many more components than those shown in FIG. 15, but it is not necessary that all conventional components of a server be shown in order to disclose an illustrative embodiment.

Figure 18:
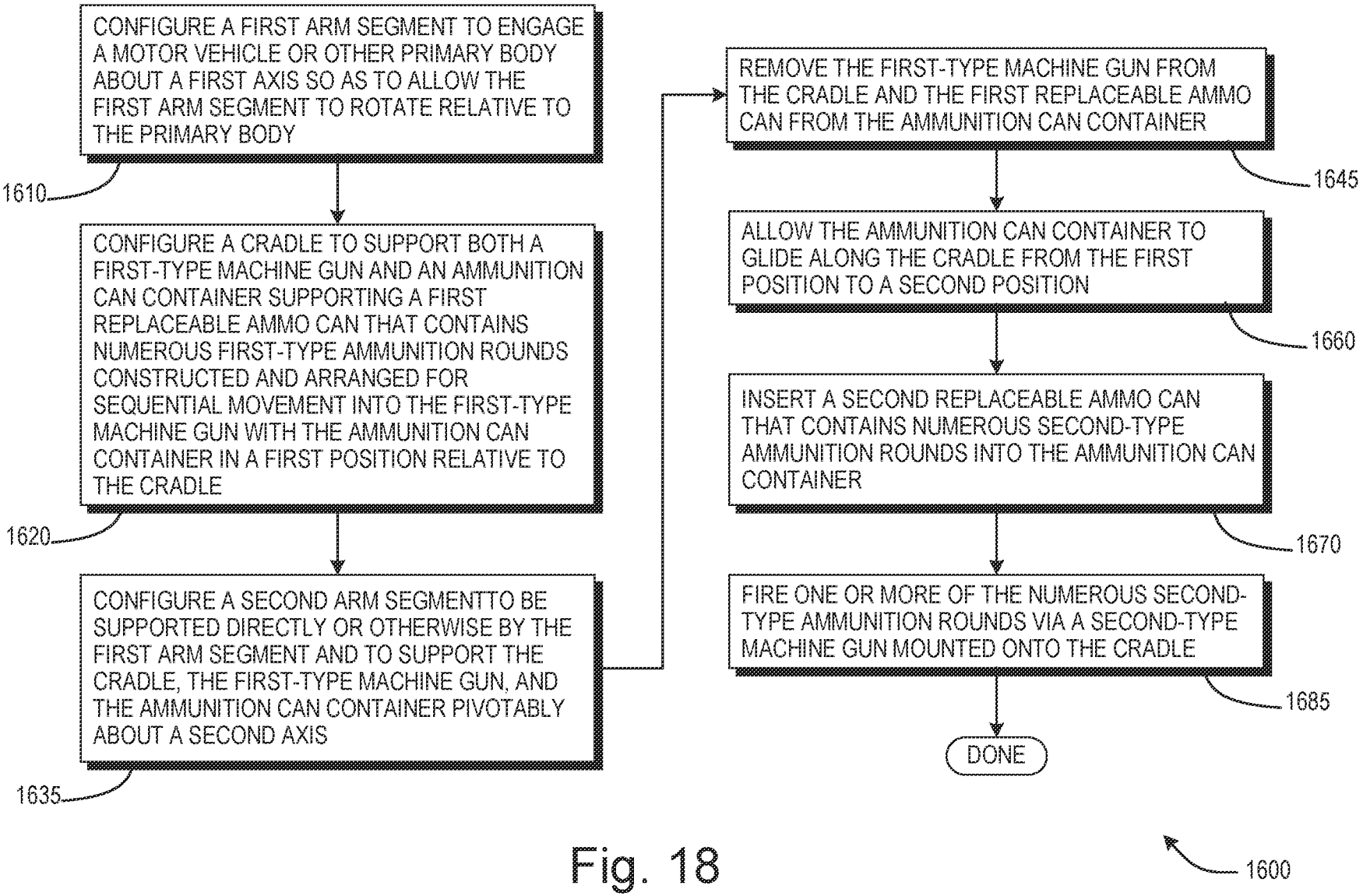
FIG. 18 depicts a flow diagram in which one or more improved technologies may be incorporated.

FIG. 18 illustrates an operational flow 1600 suitable for use with at least one embodiment, such as may be performed by one or more human operators 10 traveling with motor vehicle 310. As will be recognized by those having ordinary skill in the art, not all events of information management are illustrated in FIG. 16. Rather, for clarity, only those steps reasonably relevant to describing the improved aspects of flow 1600 are shown and described. Those having ordinary skill in the art will also recognize the present embodiment is merely one exemplary embodiment and that variations on the present embodiment may be made without departing from the scope of broader inventive concepts set forth herein.

Operation 1610 describes configuring a first arm segment to engage a primary body about a first axis so as to allow the first arm segment to rotate relative to the primary body (e.g. causing a first arm segment 361 to engage a truck, all-terrain vehicle, airplane, or other motor vehicle 310 so as to allow the first arm segment 361 to rotate relative to the motor vehicle 310). This can occur, for example, in a context in which operator 10 installed the arms 361-362 and cradle 325 as a unitary assembly and in which socket 349 comprises a (stepper or servo motor 1386 in a manual mode or other) deactivated locking mechanism, in which arm 361 was manually rotated by operator 310 into its current position, and in which motor control is integrated into a central PLC (programmable logic controller) and HMI (human machine interface) screen with these motor/controllers.

Operation 1620 describes configuring a cradle to support both a first-type machine gun and an ammunition can container supporting a first replaceable ammunition can that contains numerous first-type ammunition rounds constructed and arranged for sequential movement into the first-type machine gun with the ammunition can container in a first position relative to the cradle (e.g. causing a cradle 325 to support a first-type machine gun 391 and a nearly-empty ammunition container in an aft position relative to the cradle 325). This can occur, for example, in a context in which an ammunition can within the container was full when loaded.

Operation 1635 describes configuring a second arm segment to be supported by the first arm segment and to support the cradle, the first-type machine gun, and the ammunition can container pivotably about a second axis (e.g. configuring a second arm segment 362 to be supported indirectly by the first arm segment 361 and to support the cradle 325 and the first-type machine gun 391 pivotably about a second axis 342). This can occur, for example, in a context the arm segments 361-362 and member 363 were assembled before operation 1610 and in which operation 1635 comprised dropping the assembly into place and then putting the cradle 325 onto the second arm segment 362.

Operation 1645 describes removing the first-type machine gun from the cradle and the first replaceable ammunition can from the ammunition can container (e.g. removing the last few rounds and first-type machine gun 391 from the cradle 325). This can occur, for example, in a context in which the ammunition can was depleted by gun 391 being fired repeatedly at a target.

Operation 1660 describes allowing the ammunition can container to glide along the cradle from the first position to a second position (e.g. allowing the container to glide forward along the cradle 325 to a suitable position for use with machine gun 192). This can occur, for example, in a context in which the first-type machine gun 391 resembles gun 191 as depicted in FIG. 1.

Operation 1670 describes inserting a second replaceable ammunition can that contains numerous second-type ammunition rounds into the ammunition can container (e.g. inserting can 267 into the ammunition can container). This can occur, for example, in a context in which the cradle 325 supports a container like the container 160B of FIG. 2.

Operation 1685 describes firing one or more of the numerous second-type ammunition rounds via a second-type machine gun mounted onto the cradle (e.g. firing one or more of the newly-inserted rounds 268 via a machine gun 192 recently mounted onto the cradle 325). This can occur, for example, in a context in which a local inventory of the first-type ammunition rounds is insufficient for completing a mission safely, necessitating the changeover.

Referring again to various combinations of the figures described above, one scenario of interest comprises a relocation or other security context that includes armed vehicular travel. In some variants a system 100, 200, 300, 400, 500 described herein may be configured to provide suitable feedback 1396 or setup instructions to a local operator 10 (e.g. by interface module 1331 relaying such information via an earpiece or other article worn by the operator 10). This can occur, for example, in a context in which a voltage configuration 1351 manifests a digital expression of such feedback 1396.

Alternatively or additionally in some variants a system 100, 200, 300, 400, 500 described herein may be configured to associate a particular firearm with its current primary body 110 and selected mounting position (e.g. by linking module 1332 receiving such operational data 1395 as user input 1408 upon installation). This can occur, for example, in a context in which a voltage configuration 1352 manifests such configuration or status data as a voltage configuration 1352.

Alternatively or additionally in some variants a system 100, 200, 300, 400, 500 described herein may be configured to initiate setup suitability or other diagnostics in response to an indication 1408 of an onsite setup protocol being complete (e.g. by invocation module 1333 activating a control module 1334 to move a firearm and a recognition module 1335 to verify that the firearm actually moved). This can occur, for example, in a context in which an audible or human-readable explanation of the protocol (e.g. step-by-step instructions) is manifested as a voltage configuration 1353 thereof.

In some variants a system 100, 200, 300, 400, 500 described herein may be configured to aim a selected firearm at a target within its angular range as an automatic and conditional response partly based on the target being located and partly based on such automation being active (e.g. by control module 1334 implementing an aiming protocol at an identified potential threat using some or all of the motor controllers 1486-1489 described herein). This can occur, for example, in a context in which a voltage configuration 1354 manifests coordinates of the target or other components of a map 1560.

Alternatively or additionally in some variants a system 100, 200, 300, 400, 500 described herein may be configured to signal an elevated alert status or other appropriate response as an automatic and conditional response to an automatic or other local indication 1409 of immediate danger (e.g. by recognition module 1335 discerning a sound or appearance of inbound gunfire or explosions). This can occur, for example, in a context in which thresholds or other recognition criteria of interest are manifested as a voltage configuration 1355.

Alternatively or additionally in some variants a system 100, 200, 300, 400, 500 described herein may be configured to fire a weapons-hot firearm or aim a less-enabled firearm as an automatic and conditional response to one or more herein-described conditions (e.g. by response module 1336 acting upon a protocol selected by an onsite operator 10). This can occur, for example, in a context in which a voltage configuration 1356 manifests a digital expression of such response protocols.

In light of teachings herein, numerous existing techniques may be applied for accommodating different firearm and mounting types as described herein without undue experimentation. See, e.g., U.S. patent Ser. No. 10/782,101 ("Powered mount for firearm"); U.S. patent Ser. No. 10/753,693 ("Ammunition storage system"); U.S. patent Ser. No.

10/739,092 ("Device for ejecting cartridges and/or links from a chain or ammunition strip connected to a main and/or secondary weapon"); U.S. patent Ser. No. 10/415,908 ("Ammunition supply system"); U.S. patent Ser. No. 10/184,741 ("Drum magazine assembly and methods"); U.S. Pat. No. 10,101,109 ("Submachine gun conversion unit"); U.S. Pat. No. 9,618,290 ("Weapon barrel assembly"); U.S. Pat. No. 9,568,267 ("Configurable weapon station having under armor reload"); U.S. Pat. No. 9,316,457 ("Weapon mounting system for firearms"); U.S. Pat. No. 9,046,319 ("Mount for firearms"); U.S. Pat. No. 8,578,644 ("Light and accessory mount for a weapon system"); U.S. Pat. No. 6,283,428 ("Swing arm mount system"); U.S. Pat. No."); U.S. Pub. No. 20200256630 ("Speed loader for firearm magazines"); U.S. Pub. No. 20200096271 ("Quick Loading Ammunition Magazine"); U.S. Pub. No. 20200049438 ("Loading cartridges into a firearm magazine"); U.S. Pub. No. 20150198397 ("Semi-automatic rifle receiver with integrated scope mount"); U.S. Pub. No. 20100175547 ("Reciprocally-cycled, externally-actuated weapon"); www.youtube.com/watch?v=4IK0aQU_8kk; www.youtube.com/watch?v=lWvE1gNZmoQ; and www.youtube.com/watch?v=rQAijFuBbik. These resources are incorporated herein by reference to the extent not inconsistent herewith.

In light of teachings herein, numerous existing techniques may be applied for mounting and operating components as described herein without undue experimentation. See, e.g., U.S. patent Ser. No. 10/518,715 ("Vehicle mounting device for surveillance equipment"); U.S. patent Ser. No. 10/502,529 ("Apparatus and method for calculating aiming point information"); U.S. patent Ser. No. 10/309,745 ("Mobile turret weapon delivery system"); U.S. patent Ser. No. 10/212,876 ("Aerial deployment planting methods and systems"); U.S. patent Ser. No. 10/180,296 ("Firearm adapted to use linked ammunition and kit for converting magazine-fed firearm to same"); U.S. patent Ser. No. 10/006,735 ("Mounting assembly for a firearm"); U.S. Pat. No. 9,733,644 ("Unmanned device interaction methods and systems"); U.S. Pat. No. 9,702,649 ("Reciprocally-cycled weapon"); U.S. Pat. No. 9,689,645 ("Interface for a sighting device for a firearm"); U.S. Pat. No. 9,644,916 ("Modular weapon station system"); U.S. Pat. No. 9,568,267 ("Configurable weapon station having under armor reload"); U.S. Pat. No. 9,316,457 ("Weapon mounting system for firearms"); U.S. Pat. No. 9,056,594 ("Soldier platform system"); U.S. Pat. No. 9,038,524 ("Firearm with enhanced recoil and control characters"). These resources are incorporated herein by reference to the extent not inconsistent herewith.

Although various operational flows are presented in a sequence(s), it should be understood that the various operations may be performed in other orders than those which are illustrated or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

While various system, method, article of manufacture, or other embodiments or aspects have been disclosed above, also, other combinations of embodiments or aspects will be apparent to those skilled in the art in view of the above disclosure. The various embodiments and aspects disclosed above are for purposes of illustration and are not intended to be limiting.

What is claimed is:

1. A firearm positioning system adapted for interconnecting a firearm to a framework of a vehicle, the system comprising:

a first arm segment pivotably engaged to a primary body, wherein the first arm segment is configured to rotate about a first axis relative to the primary body;

a second arm segment pivotably engaged to the first arm segment, wherein the second arm segment is configured to rotate about a second axis relative to the first arm segment;

a first release configured to releasably lock movement of the first arm segment relative to the primary body and a second release configured to releasably lock movement of the second arm segment relative to the first arm segment; and a cradle pivotably engaged to the second arm segment, the cradle configured to rotate vertically about an elevation axis relative to the second arm segment, the cradle configured to support a firearm and comprising:

a pintle receivable by a socket on the second arm segment, wherein the pintle is rotatable in the socket;

a pair of opposing hook arms at a first end of the cradle, the pair of hook arms configured to receive a front end of a firearm; and a backstop assembly at a second end opposite the first end, the backstop assembly configured to releasably secure a back end of the firearm to the cradle, wherein the backstop assembly comprises a post and a pin movable from a first open position to a second closed position, when in the first open position the pin does not contact the post, and in the second closed position the pin contacts the post.

2. The system of claim 1, wherein the second arm segment has a length less than the first arm segment.

3. The system of claim 1, wherein the primary body is an upper portion of a roll-cage of a vehicle.

4. The system of claim 1, wherein the pin is biased to the second closed position.

5. The system of claim 1, further comprising an elevation pin configured to releasably lock the vertical range of motion of the cradle relative to the second arm segment.

6. The system of claim 1, wherein the cradle is configured to support a container, the container configured to support at least one ammunition can and is releasably securable to the cradle.

7. The system of claim 6, wherein the container supports two ammunition cans.

8. The system of claim 6, wherein the container comprises one or more sliders and the cradle comprises at least one rail configured to receive the sliders.

9. A firearm positioning system, comprising:

a first arm segment pivotably engaged to a primary body;

a second arm segment pivotably engaged to the first arm segment;

a cradle pivotably engaged to the second arm segment, the cradle configured to support a firearm and a container, the cradle comprising:

a removably engaging attachment mechanism positioned at a first end of the cradle, the removably engaging attachment mechanism configured to receive and removably engage a front end of a firearm;

a backstop assembly at a second end opposite the first end, the backstop assembly configured to releasably secure a back end of the firearm to the cradle; and at least one rail, wherein the container comprises one or more sliders receivable by the at least one rail.

10. The system of claim 9, wherein the removably engaging attachment mechanism comprises a pair of opposing hook arms for engaging the front end of the firearm.

11. The system of claim 9, wherein the second arm segment has a length less than the first arm segment.

12. The system of claim 9, wherein the primary body is an upper portion of a roll-cage of a vehicle.

13. The system of claim 9, wherein the backstop assembly comprises a post and a pin movable from a first position to a second position, wherein the pin contacts the post in a closed position when the pin is in the second position and the pin does not contact the post in an open position when the pin is in the first position.

14. The system of claim 13, wherein the pin is biased to the second position.

15. The system of claim 9, wherein the cradle is adjustable in a vertical range of motion relative to the second arm segment.

16. The system of claim 15, further comprising an elevation pin configured to releasably lock the vertical range of motion of the cradle relative to the second arm segment.

17. The system of claim 9, wherein the container is configured to support at least one ammunition can and is releasably securable to the cradle.

18. A method for replacing a first firearm with a second firearm, comprising:

configuring a first arm segment to engage a primary body about a first axis, the first arm segment rotatable about the first axis relative to the primary body;

configuring a cradle to support a first firearm and a container holding a plurality of first ammunition rounds, the cradle pivotably coupled to a second arm segment, the second arm segment pivotably coupled to the cradle at a first end and pivotably coupled to the first arm segment at a second end, the cradle having a pair of channels, a first end to receive a front end of the first firearm, and a backstop assembly at a second end to releasably secure a back end of the first firearm to the cradle, wherein the backstop assembly comprises a post and a pin movable from a first open position to a second closed position, when in the first open position the pin does not contact the post, and in the second closed position the pin contacts the post;

releasing the backstop assembly and removing the first firearm from the cradle;

replacing the plurality of first ammunition rounds with a plurality of second ammunition rounds in the container, wherein the plurality of first ammunition rounds and the plurality of second ammunition rounds are different; and configuring the cradle to support a second firearm, wherein the first firearm and the second firearm are different.

* * * * *